US011306556B2

(12) United States Patent
Price

(10) Patent No.: US 11,306,556 B2
(45) Date of Patent: Apr. 19, 2022

(54) FREEING STUCK SUBTERRANEAN SERVICE TOOLS

(71) Applicant: Chevron U.S.A. Inc., San Ramon, CA (US)

(72) Inventor: Paul Aaron Price, Richmond, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/879,872

(22) Filed: May 21, 2020

(65) Prior Publication Data

US 2021/0363848 A1 Nov. 25, 2021

(51) Int. Cl.
*E21B 31/107* (2006.01)
*E21B 29/00* (2006.01)
*E21B 34/06* (2006.01)

(52) U.S. Cl.
CPC ..... *E21B 31/107* (2013.01); *E21B 29/00* (2013.01); *E21B 34/063* (2013.01)

(58) Field of Classification Search
CPC .. E21B 31/107; E21B 31/113; E21B 31/1135; E21B 31/1075; E21B 29/00; E21B 34/063
See application file for complete search history.

(56) References Cited

U.S. PATENT DOCUMENTS 4,341,272 A * 7/1982 Marshall ..... E21B 31/113 166/301
4,807,709 A * 2/1989 Falgout, Sr. ..... E21B 31/113 175/296
5,029,642 A * 7/1991 Crawford ..... E21B 31/113 166/72
5,327,974 A * 7/1994 Donovan ..... E21B 17/22 166/311
2004/0045716 A1* 3/2004 Bakke ..... E21B 31/113 166/301
2013/0277057 A1* 10/2013 Evans ..... E21B 31/107 166/311
2013/0284453 A1* 10/2013 Vick, Jr. ..... E21B 34/14 166/373
2017/0016300 A1* 1/2017 Collins ..... E21B 31/107
2020/0024923 A1* 1/2020 Jones ..... E21B 31/16

* cited by examiner

*Primary Examiner* — Christopher J Sebesta
(74) *Attorney, Agent, or Firm* — King & Spalding LLP

(57) ABSTRACT

An assembly disposed within a subterranean wellbore can include a first dislodging tool coupled to a bottom end of a tubing string, wherein the first dislodging tool, when enabled at a first time, performs a first action to free at least one service tool, disposed below the first dislodging tool in the subterranean wellbore, from being stuck.

17 Claims, 22 Drawing Sheets

791

892

FREEING STUCK SUBTERRANEAN SERVICE TOOLS

TECHNICAL FIELD

The present application relates generally to freeing gravel pack and/or frac pack service tools, incorporated in or toward a bottom hole assembly (BHA), that have become stuck or otherwise inhibited during or soon after operations in a subterranean formation.

BACKGROUND

While performing certain subterranean operations (e.g., sand control fracturing, gravel pack placement operations), the tubing string (e.g., drill pipe) and equipment (e.g., frac pack/gravel pack service tool and associated seals) used to perform those subterranean operations must be removed from the wellbore or portion thereof (e.g., the packer bore of the lower completion assembly). Due to downhole debris, pipe tensile limits, and the elastic nature of the drill pipe, service tools and other equipment used to perform the subterranean operations can become stuck, making it difficult to pull free for retrieval at the surface.

SUMMARY

In general, in one aspect, the disclosure relates to an assembly disposed within a subterranean wellbore. The assembly can include a first dislodging tool coupled to a bottom end of a tube pipe of a tubing string, where the first dislodging tool, when enabled at a first time, performs a first action to free at least one service tool, disposed below the first dislodging tool in the subterranean wellbore, from being stuck.

In another aspect, the disclosure can generally relate to a method for freeing a service tool from a subterranean wellbore. The method can include determining, after a service operation has been performed by the service tool, that the service tool is stuck within the subterranean wellbore. The method can also include performing, using a first part of an assembly disposed in the subterranean wellbore between a tubing string and the service tool, a first action to free the service tool, disposed below the assembly in the subterranean wellbore, from being stuck. The method can further include retrieving, after performing the first action, the service tool by removing the tubing string from the subterranean formation.

These and other aspects, objects, features, and embodiments will be apparent from the following description and the appended claims.

BRIEF DESCRIPTION OF THE DRAWINGS

The drawings illustrate only example embodiments of systems and devices for freeing stuck subterranean service tools in a subterranean wellbore and are therefore not to be considered limiting of its scope, as freeing stuck subterranean service tools within a wellbore may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DESCRIPTION OF EXAMPLE EMBODIMENTS

Figure 1:
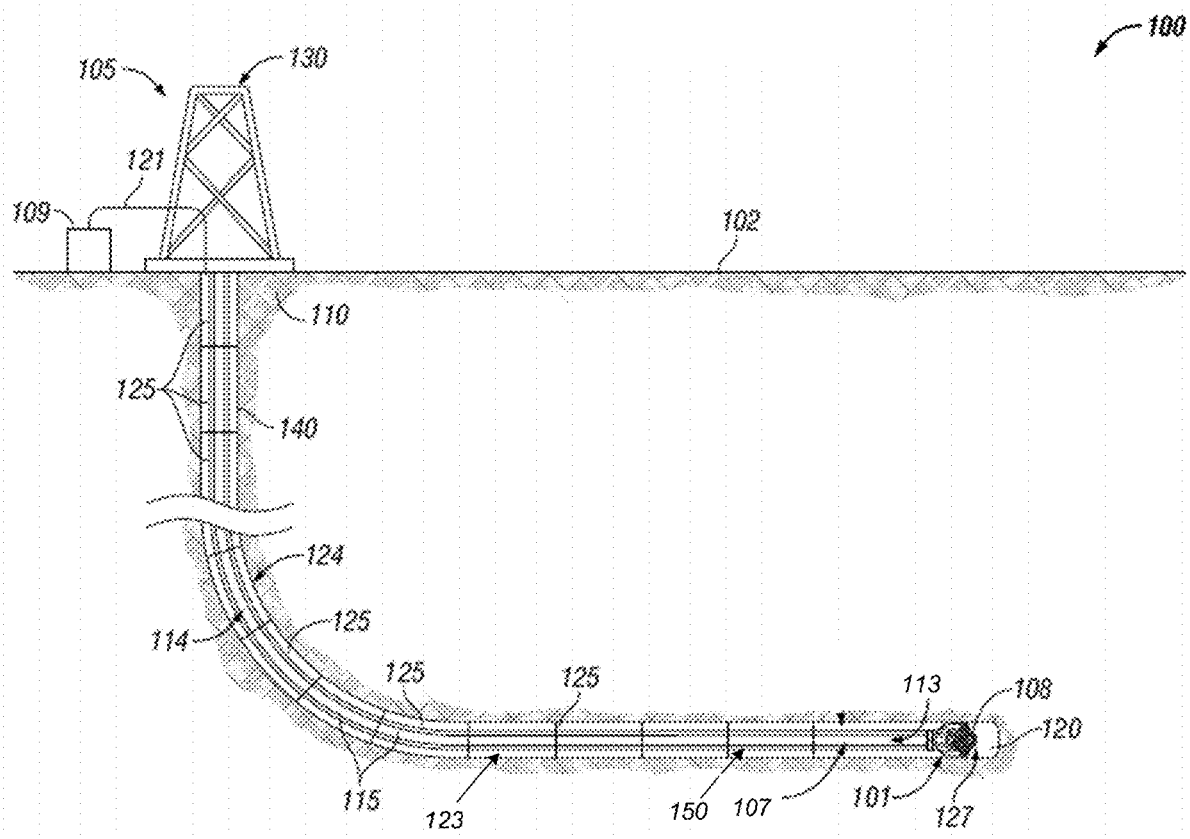
FIG. 1 shows a schematic diagram of a field system with a subterranean wellbore in which example embodiments can be used.

The example embodiments discussed herein are directed to systems, methods, and devices for freeing stuck subterranean service tools. While example embodiments are described herein as being used in subterranean formations (e.g., subterranean wellbores), example embodiments can also be used in any other type of environment where long distances are involved. Such other environments can include, but are not limited to, a subsea operation. Also, while example embodiments are designed for harsh (e.g., high temperature, high pressure) environments, example embodiments can also be used in any other type of environment (e.g., indoor, outdoor, hazardous, non-hazardous, high humidity, low temperature, corrosive, sterile, high vibration).

Service tools that can be freed (unstuck) using example embodiments can be used in one or more different subterranean operations. For example, a service tool can be a gravel pack service tool. In such a case, the gravel pack service tool includes a downhole filter designed to prevent sand from the formation to become mixed into the fluid. In such a case, the formation sand is held in place by a properly-sized gravel pack sand that, in turn, is held in place with a properly-sized screen. At times, a gravel pack service tool can become stuck in the wellbore.

As another example, a service tool can be a frac pack service tool (also called a fracturing pack service tool). In such a case, the frac pack service tool is structured similarly with to a gravel pack in terms of having a filter, but the frac pack service tool is used during a fracturing operation. When fracturing occurs, parts of the wellbore wall in the formation can break loose and mix with the fluid. The frac pack service tool is designed to keep much of these parts out of the fluid. At times, a frac pack service tool can become stuck in the wellbore. The particular design and/or function of a service tool can vary and does not impact the ability of example embodiments to free the service tool that is stuck in the subterranean formation.

Similarly, the one or more dislodging tools of example assemblies used to free stuck service tools in a subterranean formation can have a number of different designs. For example, the dislodging tools in the form of a disconnect tool, a jarring tool, or a reverse circulation tool can have varying designs to serve the function for which they are designed to perform. A few examples of these dislodging tools are shown and described below.

A user as described herein may be any person that is involved with a subterranean wellbore, including operations (e.g., exploration, production) thereof. Examples of a user may include, but are not limited to, a roughneck, a company representative, a drilling engineer, a tool pusher, a service hand, a field engineer, an electrician, a mechanic, an engineering services company, an operator, a consultant, a contractor, and a manufacturer's representative. A user can include a user system (e.g., a smart phone, a laptop computer, an electronic tablet) for communication, control, data collection, reporting, and/or other applicable functions.

Any example system for freeing stuck service tools in a subterranean wellbore, or portions (e.g., components) thereof, described herein can be made from a single piece (as from a mold or extrusion). When an example system (or portion thereof) for freeing stuck service tools in a subterranean wellbore is made from a single piece, the single piece can be cut out, bent, stamped, and/or otherwise shaped to create certain features, elements, or other portions of a component. Alternatively, an example system (or portions thereof) for freeing stuck service tools in a subterranean wellbore can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, abut against, fasten, and/or perform other functions aside from strictly coupling. In addition, each component and/or feature described herein (including each component of an example system for freeing stuck service tools in a subterranean wellbore) can be made of one or more of a number of suitable materials, including but not limited to metal (e.g., stainless steel), ceramic, rubber, glass, and plastic.

A coupling feature (including a complementary coupling feature) as described herein can allow one or more components and/or portions of an example downhole on-demand extended-life power source system (e.g., a housing) to become mechanically coupled, directly or indirectly, to another portion (e.g., an array of energy storage devices) of the downhole on-demand extended-life power source system and/or another component of a bottom hole assembly (BHA) or tubing string. A coupling feature can include, but is not limited to, a portion of a hinge, an aperture, a recessed area, a protrusion, a slot, a spring clip, a tab, a detent, and mating threads. One portion of an example downhole on-demand extended-life power source system can be coupled to another portion of a downhole on-demand extended-life power source system and/or another component of a BHA or tubing string by the direct use of one or more coupling features.

In addition, or in the alternative, a portion of an example system for freeing stuck service tools in a subterranean wellbore can be coupled to another portion of the system for freeing stuck service tools in a subterranean wellbore and/or another component of a BHA or tubing string using one or more independent devices that interact with one or more coupling features disposed on a component of the system for freeing stuck service tools in a subterranean wellbore. Examples of such devices can include, but are not limited to, a pin, a hinge, a fastening device (e.g., a bolt, a screw, a rivet), an adapter, and a spring. One coupling feature described herein can be the same as, or different than, one or more other coupling features described herein. A complementary coupling feature as described herein can be a coupling feature that mechanically couples, directly or indirectly, with another coupling feature.

When used in certain systems (e.g., subterranean field operations), example embodiments can be designed to help such systems comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA).

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of systems for freeing stuck service tools in a subterranean wellbore will be described more fully hereinafter with reference to the accompanying drawings, in which example embodiments of systems for freeing stuck service tools in a subterranean wellbore are shown. Systems for freeing stuck service tools in a subterranean wellbore may, however, be embodied in many different forms and should not be construed as limited to the example embodiments set forth herein. Rather, these example embodiments are provided so that this disclosure will be thorough and complete, and will fully convey the scope of systems for freeing stuck service tools in a subterranean wellbore to those of ordinary skill in the art. Like, but not necessarily the same, elements (also sometimes called components) in the various figures are denoted by like reference numerals for consistency.

Terms such as "first", "second", "outer", "inner", "top", "bottom", "distal", "proximal", "on", and "within" are used merely to distinguish one component (or part of a component or state of a component) from another. This list of terms is not exclusive. Such terms are not meant to denote a preference or a particular orientation, and they are not meant to limit embodiments of systems for freeing stuck service tools in a subterranean wellbore. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a schematic diagram of a land-based field system 100 in which assemblies 150 for freeing inhibited (e.g., stuck) service tools in a subterranean wellbore 120 can be used within a subterranean formation 110 in accordance with one or more example embodiments. Referring to FIG. 1, the field system 100 in this example includes the wellbore 120 that is formed by a wall 140 in the subterranean formation 110 using field equipment 130. The field equipment 130 can be located above a surface 102, and/or within the wellbore 120. The surface 102 can be ground level for an on-shore application and the sea floor for an off-shore application. The point where the wellbore 120 begins at the surface 102 can be called the entry point.

The subterranean formation 110 can include one or more of a number of formation types, including but not limited to shale, limestone, sandstone, clay, sand, and salt. In certain embodiments, the subterranean formation 110 can also include one or more reservoirs in which one or more subterranean resources (e.g., oil, gas, water, steam) can be located. One or more of a number of field operations (e.g., fracking, coring, tripping, drilling, setting casing, extracting downhole resources) can be performed to reach an objective of a user with respect to the subterranean formation 110. During these field operations, the service tools used in the wellbore 120 can become stuck or otherwise inhibited, preventing a user (e.g., an operator) from extracting the service tools from the wellbore 120.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., insert casing pipe, extract downhole materials) the wellbore 120. The field equipment 130 can be positioned and/or assembled at the surface 102. The field equipment 130 can include, but is not limited to, a circulation unit 109 (including circulation line 121, as explained below), a derrick, a tool pusher, a clamp, a tong, drill pipe, a drill bit, example isolator subs, tubing housing (also sometimes called tubing pipe), a power source, and casing pipe.

The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of casing pipe to be inserted at a certain depth in the wellbore 120.

Inserted into and disposed within the wellbore 120 of FIG. 1 are a number of casing pipes 125 that are coupled to each other end-to-end to form the casing string 124. In this case, each end of a casing pipe 125 has mating threads (a type of coupling feature) disposed thereon, allowing a casing pipe 125 to be mechanically coupled to an adjacent casing pipe 125 in an end-to-end configuration. The casing pipes 125 of the casing string 124 can be mechanically coupled to each other directly or using a coupling device, such as a coupling sleeve. The casing string 124 is not disposed in the entire wellbore 120. Often, the casing string 124 is disposed from approximately the surface 102 to some other point in the wellbore 120. The open hole portion 127 of the wellbore 120 extends beyond the casing string 124 at the distal end of the wellbore 120.

Each casing pipe 125 of the casing string 124 can have a length and a width (e.g., outer diameter). The length of a casing pipe 125 can vary. For example, a common length of a casing pipe 125 is approximately 40 feet. The length of a casing pipe 125 can be longer (e.g., 60 feet) or shorter (e.g., 10 feet) than 40 feet. The width of a casing pipe 125 can also vary and can depend on the cross-sectional shape of the casing pipe 125. For example, when the cross-sectional shape of the casing pipe 125 is circular, the width can refer to an outer diameter, an inner diameter, or some other form of measurement of the casing pipe 125. Examples of a width in terms of an outer diameter can include, but are not limited to, 7 inches, 7⅝ inches, 8⅝ inches, 10¾ inches, 13⅜ inches, and 14 inches.

The size (e.g., width, length) of the casing string 124 can be based on the information gathered using field equipment 130 with respect to the wellbore 120. The walls of the casing string 124 have an inner surface that forms a cavity 113 that traverses the length of the casing string 124. Each casing pipe 125 can be made of one or more of a number of suitable materials, including but not limited to stainless steel. In certain example embodiments, each casing pipe 125 is made of one or more of a number of electrically conductive materials.

A number of tubing pipes 115 that are coupled to each other and inserted inside the cavity 113 form the tubing string 114. The collection of tubing pipes 115 can be called a tubing string 114. The tubing pipes 115 of the tubing string 114 are mechanically coupled to each other end-to-end, usually with mating threads (a type of coupling feature). The tubing pipes 115 of the tubing string 114 can be mechanically coupled to each other directly or using a coupling device, such as a coupling sleeve or an isolator sub (both not shown). Also disposed within and/or attached to a distal end of the tubing string 114 can be one or more example assemblies 150. In this example, there is one example assembly 150 disposed between the distal end of the tubing string 114 and the service tool 107.

Each tubing pipe 115 of the tubing string 114 can have a length and a width (e.g., outer diameter). The length of a tubing pipe 115 can vary. For example, a common length of a tubing pipe 115 is approximately 30 feet. The length of a tubing pipe 115 can be longer (e.g., 40 feet) or shorter (e.g., 10 feet) than 30 feet. Also, the length of a tubing pipe 115 can be the same as, or different than, the length of an adjacent casing pipe 125. The width of a tubing pipe 115 can also vary and can depend on one or more of a number of factors, including but not limited to the target depth of the wellbore 120, the total length of the wellbore 120, the inner diameter of the adjacent casing pipe 125, and the curvature of the wellbore 120.

The width of a tubing pipe 115 can refer to an outer diameter, an inner diameter, or some other form of measurement of the tubing pipe 115. Examples of a width in terms of an outer diameter for a tubing pipe 115 can include, but are not limited to, 7 inches, 5 inches, and 4 inches. In some cases, the outer diameter of the tubing pipe 115 can be such that a gap exists between the tubing pipe 115 and an adjacent casing pipe 125. The walls of the tubing pipe 115 have an inner surface that forms a cavity 123 (also called an annulus 123) that traverses the length of the tubing pipe 115. The tubing pipe 115 can be made of one or more of a number of suitable materials, including but not limited to steel.

At the distal end of the tubing string 114 within the wellbore 120 is an example assembly 150, followed by a BHA 101. The BHA 101 can include one or more of a number of components, including but not limited to a bit 108 at the far distal end, a service tool 107, a measurement-while-drilling tool, one or more tubing pipes 115, and one or more stabilizers. During a field operation, the tubing string 114, including the BHA 101, can be rotated by other field equipment 130. During a service operation, the service tool 107 is used to perform one or more of a number of operations (e.g., fracturing) from the subterranean wellbore. The tubing string 114, BHA 101 (including the service tool 107), the example assembly 150, and any other components coupled to one or more of these components can generally be referred to herein as a downhole assembly or a wellbore assembly.

The circulation unit 109 can include one or more components that allow a user to control the one or more downhole components (e.g., a portion of the BHA 101, a part of the example assembly 150) from the surface 102. Examples of such components of the circulation unit 109 can include, but are not limited to, a compressor, one or more valves, a pump, piping, and a motor. The circulating line 121 transmits fluid (e.g., drilling mud, proppant) from the circulating unit 109 downhole to the service tool 150 and/or the BHA 101 (including components thereof, such as the service tool 107).

Figure 2A:
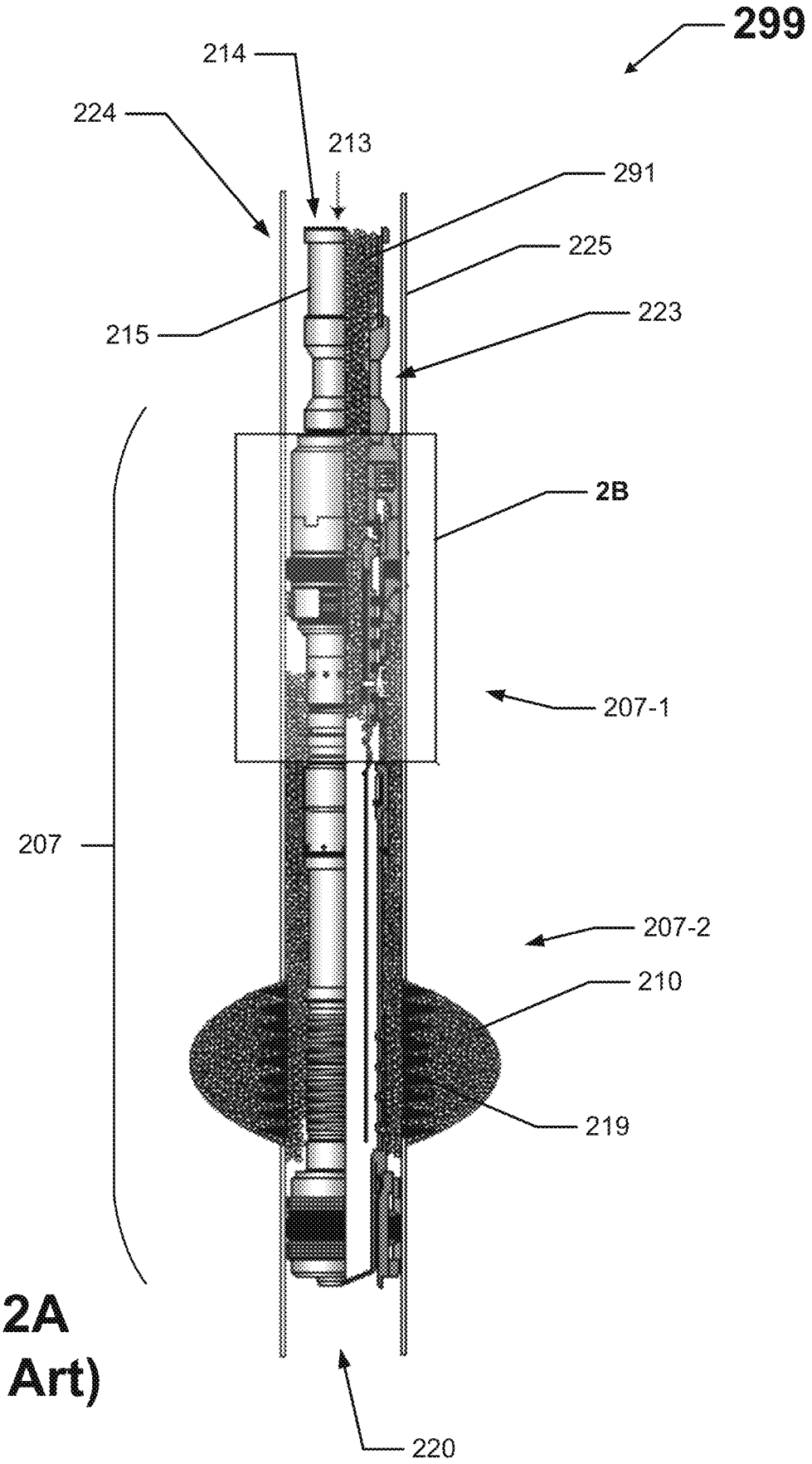
FIG. 2A (Prior Art)
FIGS. 2A through 2C show various cross-sectional side views of a subassembly used in the current art.
Figure 2B:
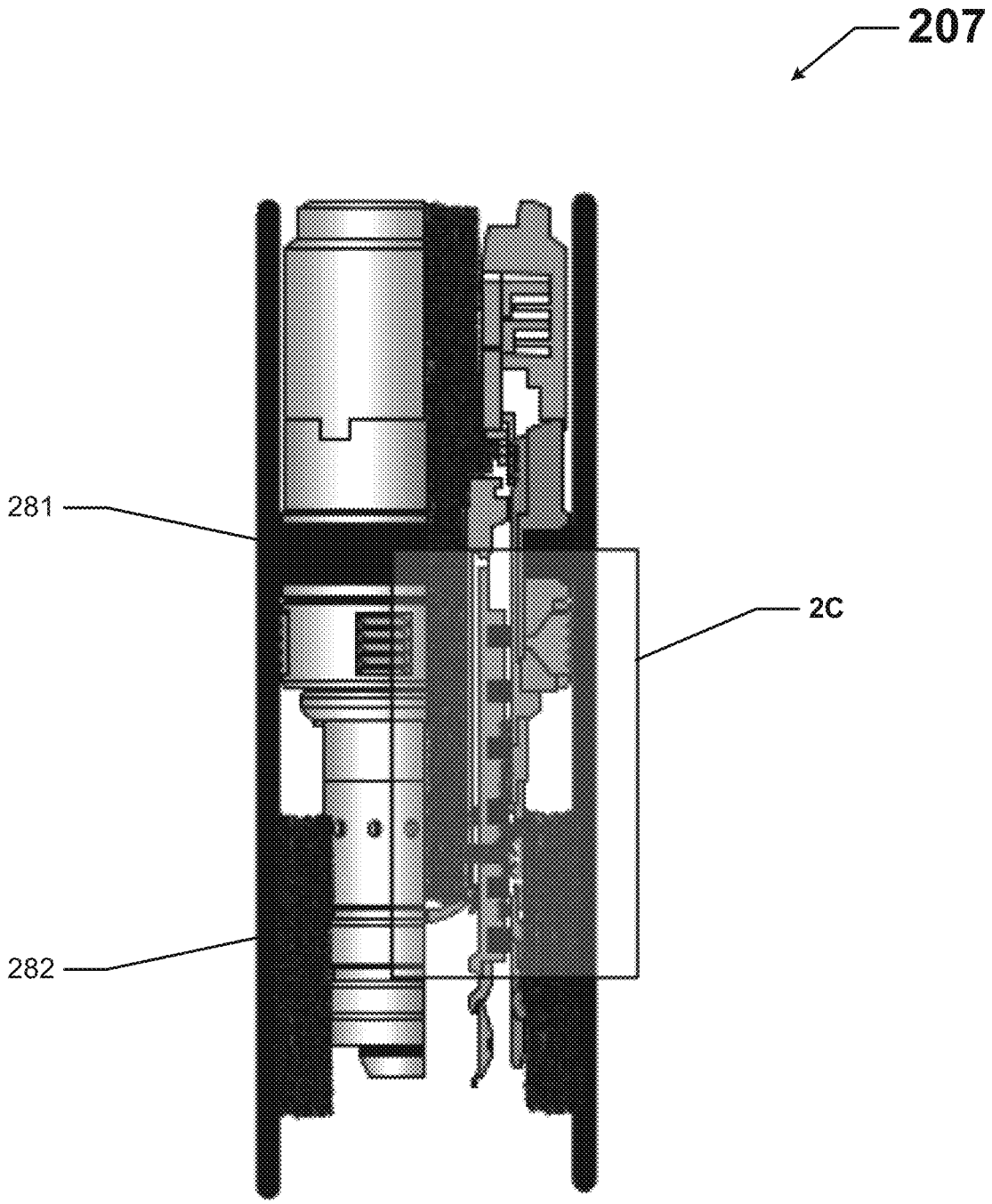
FIG. 2B (Prior Art)
Figure 2C:
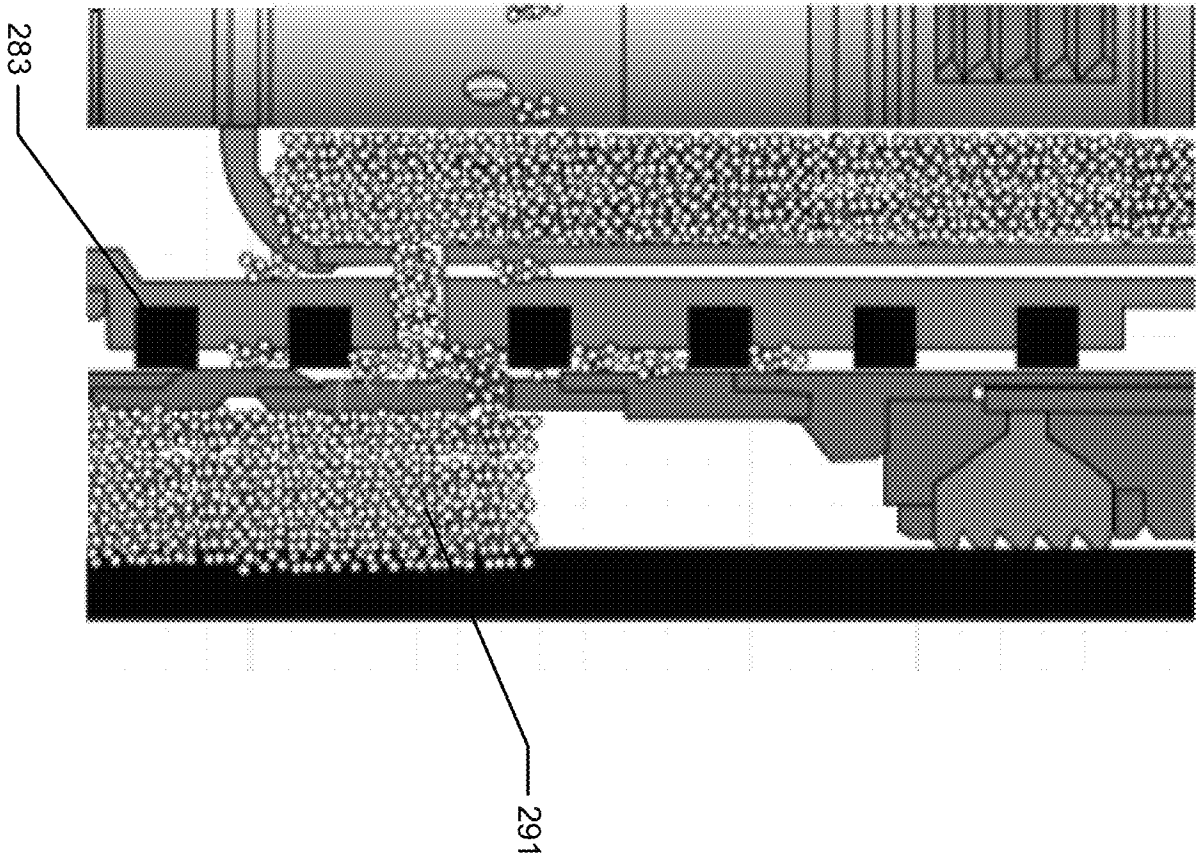
FIG. 2C (Prior Art)

FIGS. 2A through 2C show cross-sectional side views of a subassembly 299 used in the current art. Specifically, FIG. 2A shows a cross-sectional side view of the subassembly 299. FIG. 2B shows a cross-sectional side view of a service tool 207, which is part of the subassembly 299. FIG. 2C shows a detailed cross-sectional side view of part of the service tool 207. To the extent that some of the components (e.g., the tubing string 214, the tubing pipe 215, the casing string 224, the casing pipe 225) of the subassembly 299 of FIGS. 2A through 2C are also shown in FIG. 1, those components can be substantially the same as the corresponding components of the system 100 of FIG. 1 above.

Referring to FIGS. 1 through 2C, the subassembly 299 of FIG. 2A includes part of a casing string 224 that outlines a subterranean wellbore 220 in a subterranean formation 210. The subassembly 299 also includes the service tool 207 coupled to a bottom (distal) end of a tubing pipe 215 of a tubing string 214 disposed within the cavity 223 of the casing string 224. The service tool 207 in this case includes a first portion 207-1 and a second portion 207-2, where the first portion 207-1 includes a packer 281 and packer extension 282, and where the second portion 207-2 includes a gravel pack assembly 285 that creates fractures 219 in the formation 210 adjacent to the subterranean wellbore 220.

During creation of the fractures 219 by the service tool 207, a fluid 291, which in this case is a mixture of proppant, gravel, and mud, often becomes disposed in different parts within and adjacent to the service tool 207, including in and around various seals 283 inside of and around the exterior of the service tool 207, as well as in and around close-tolerance concentric components of the service tool 207. As a result, the service tool 207 becomes stuck within the casing string 224.

Removing such a stuck service tool 207 in the current art can be accomplished in a few different ways. For example, coiled tubing can be dropped down the subterranean wellbore 220, either through the annulus 213 of the tubing string 214 or in the cavity 223 between the tubing string 214 and the casing string 224. In such a case, the coiled tubing can be used to try cleaning out enough of the fluid 291 to free the combination of the drill string 214 and the service tool 207 for extraction from the subterranean wellbore 220.

If this effort is unsuccessful, then the drill string 214 can be cut at a location close to the service tool 207. Once the cut is made, the drill string 214 is removed, and then a conventional fishing operation can be performed. The fishing operation typically involves an overshot with a grapple (to latch onto the top of the remaining drill string 214 or the service tool 207) and jars to provide an upward impact to free the service tool 207 from being stuck. Once free, the service tool 207 and other remaining downhole equipment (e.g., the BHA 101) can be removed. These conventional removal processes are expensive and time-consuming. In some cases, recovery is not successful, and so the service tool 207 and remaining downhole equipment, as well as the distal end of the subterranean wellbore 220, must be abandoned.

Figure 3A:
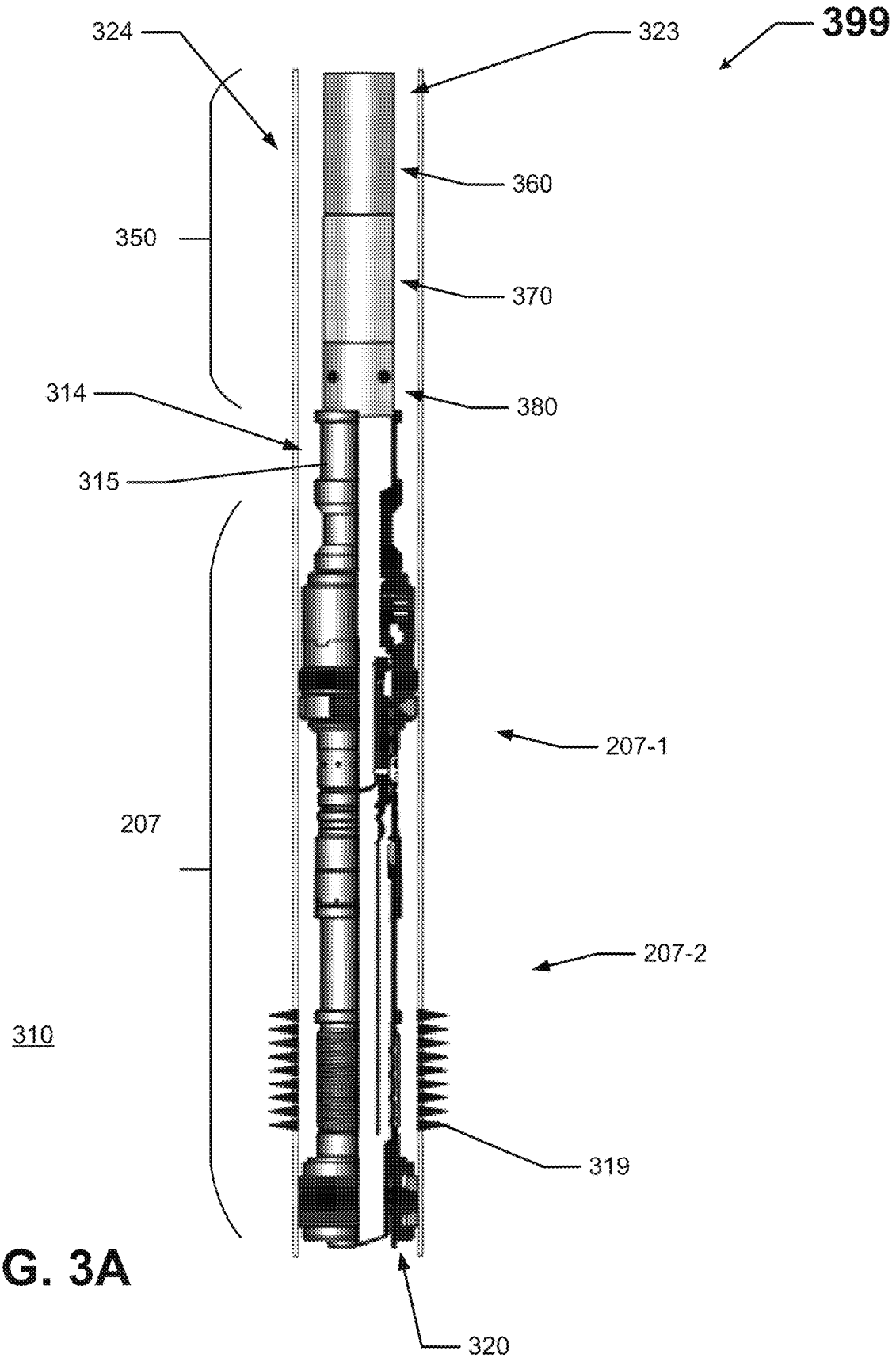
FIGS. 3A through 3E various cross-sectional side views of a subassembly in accordance with certain example embodiments.
Figure 3B:
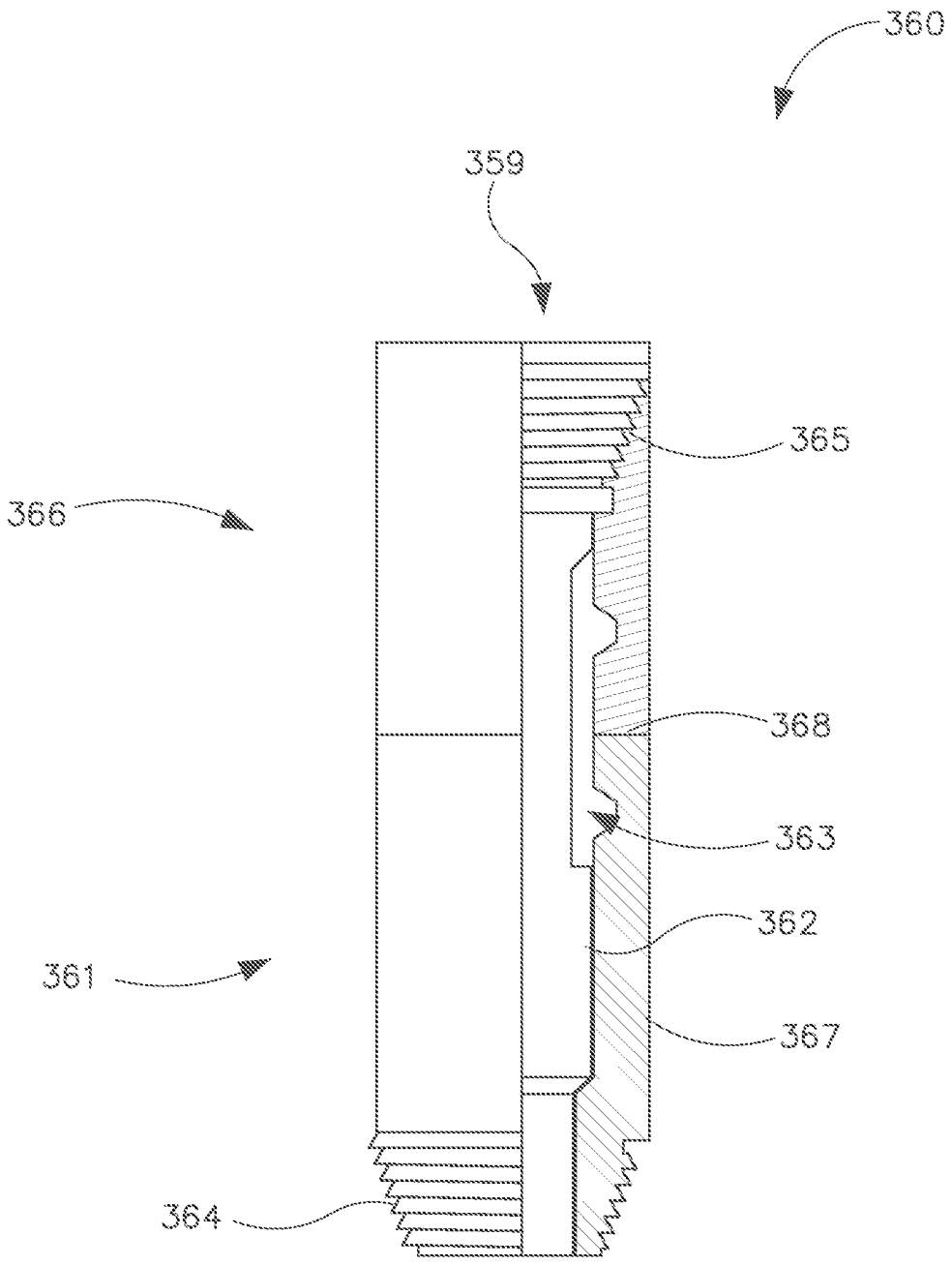
Figure 3C:
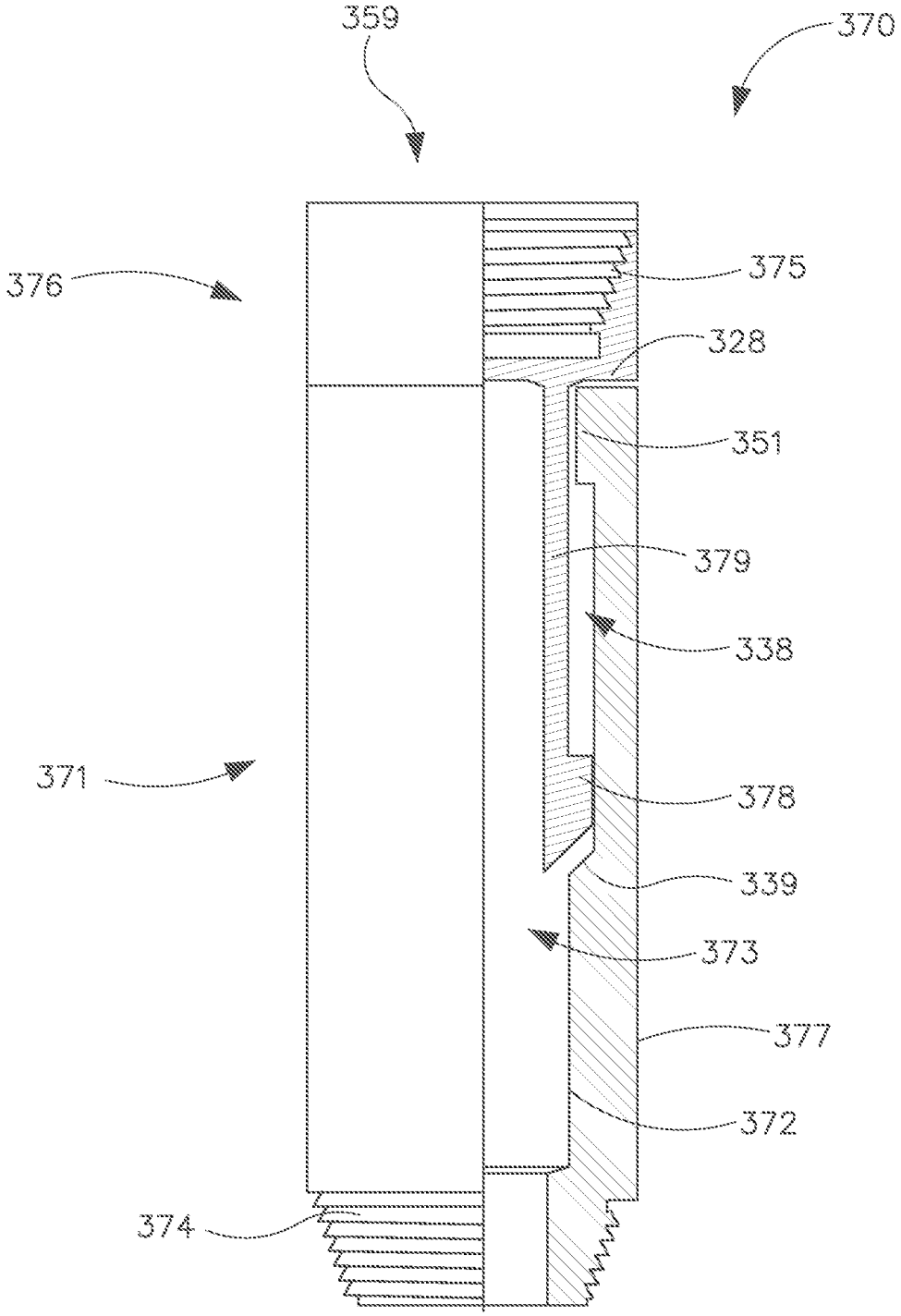
Figure 3D:
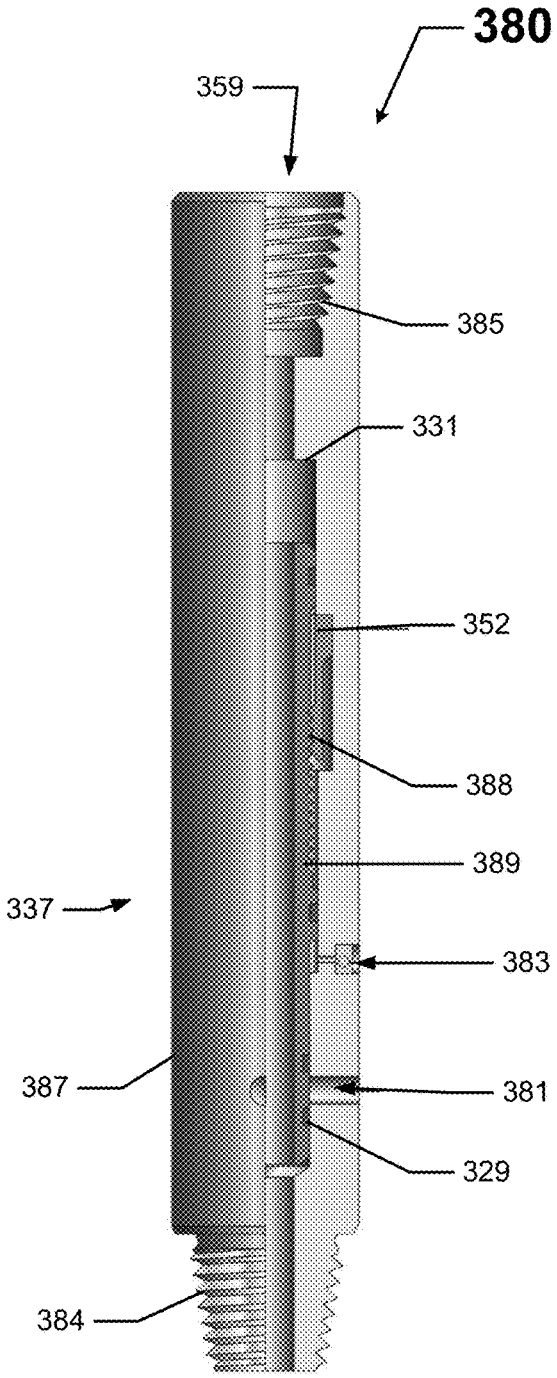
Figure 3E:
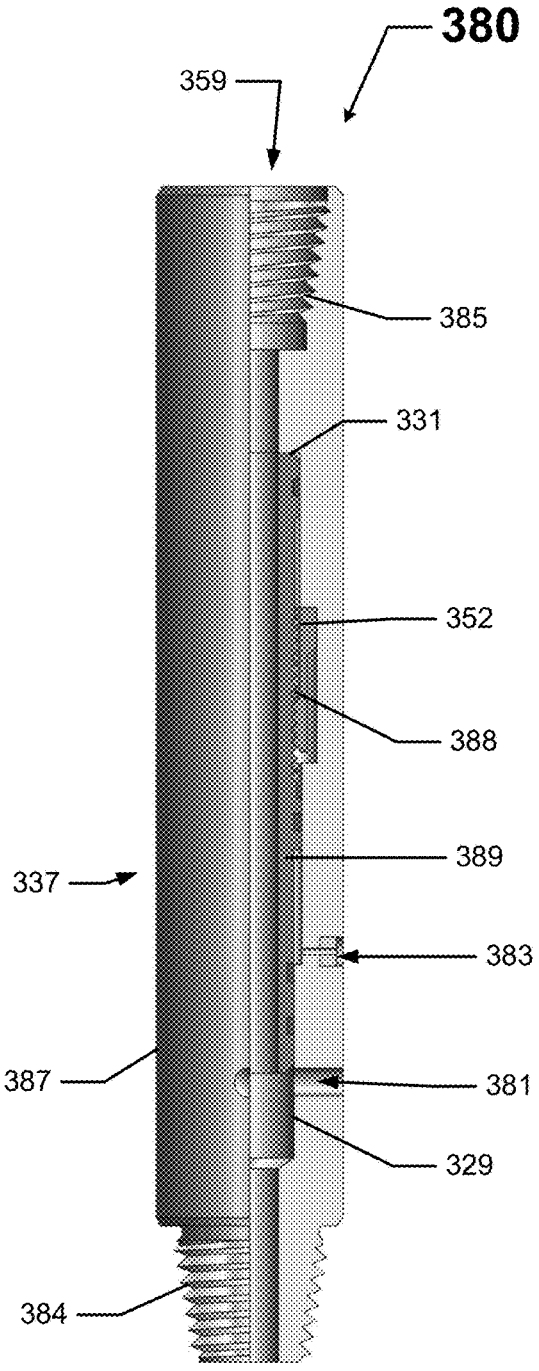

FIGS. 3A through 3E show various cross-sectional side views of a subassembly 399 in accordance with certain example embodiments. Specifically, FIG. 3A shows a cross-sectional side view of the subassembly 399 that includes an example assembly 350. FIG. 3B shows a semi-cross-sectional side view of a first dislodging tool 360 of the example assembly 350. FIG. 3C shows a semi-cross-sectional side view of a second dislodging tool 370 of the example assembly 350. FIG. 3D shows a semi-cross-sectional side view of a third dislodging tool 380 of the example assembly 350 in a closed position. FIG. 3E shows a semi-cross-sectional side view of the third dislodging tool 380 of FIG. 3D in an open position. The service tool 207 of FIG. 3A is identical to the service tool 207 of FIGS. 2A through 2C. Similarly, the tubing string 314, the tubing pipe 315, the casing string 324, the annulus 323, the subterranean formation 310, the fractures 319, and the subterranean wellbore 320 can be substantially the same as the corresponding components described above with respect to FIGS. 1 through 2C.

Referring to FIGS. 1 through 3E, the example assembly 350 is coupled to and disposed within the drill string 314 toward the bottom end of the drill string 314, proximate to the service tool 207. In alternative embodiments, the example assembly 350 can be coupled directly to the top of the service tool 207. Regardless of the location of the example assembly 350, the assembly 350 can include one or more parts, also called dislodging tools herein. In this case, the assembly 350 has three dislodging tools. Specifically, dislodging tool 360 of the assembly 350 is a disconnect tool, dislodging tool 370 of the assembly 350 is a jarring tool, and dislodging tool 380 of the assembly 350 is a reverse circulation tool.

When an example assembly 350 has multiple dislodging tools, one dislodging tool can be directly coupled to another dislodging tool (as in this case). Alternatively, one or more components (e.g., a standoff, a packer) can be disposed between two adjacent dislodging tools of an example assembly 350. In certain example embodiments, the assembly 350 (including all of its dislodging tools) is inactive during normal operations, which can be defined as any time that the service tool 207 or other downhole equipment (e.g., BHA 101) is not stuck. During these normal operations, the assembly 350 is transparent, meaning that the example assembly 350 does not affect any of the operations. However, when the service tool 207 or other downhole equipment becomes stuck, one or more portions of the example assembly 350 can become activated to dislodge the service tool 207 or other downhole equipment.

The dislodging tool 360 in the form of a disconnect tool is an optional part of an example assembly 350. When the dislodging tool 360 is present, it is used as a last resort, when the other dislodging tools of the assembly fail to free the service tool 207 from being stuck. Generally speaking, the dislodging tool 360 physically disconnects the drill string 214 and other components located above (toward the surface 102) the dislodging tool 360 from the service tool 207 and other downhole equipment (e.g., the BHA 101) within the subterranean wellbore 320.

The dislodging tool 360 in the form of a disconnect tool can have any of a number of components and/or configurations. For example, as shown in FIG. 3B, the dislodging tool 360 can include a top portion 366 and a bottom portion 361 that are separable from each other at junction 368 when the dislodging tool 360 is enabled or activated. The bottom of the bottom portion 361 includes a coupling feature 364 (in this case, mating threads) that can couple to another dislodging tool of the assembly 350, the service tool 207, a tubing pipe 315 of the tubing string 314, or some other component of a downhole assembly. Similarly, the top of the top portion 366 includes a coupling feature 365 (in this case, mating threads) that can couple to another dislodging tool of the assembly 350, a tubing pipe 315 of the tubing string 314, or some other component of a downhole assembly.

The top portion 366 and the bottom portion 361 have an outer surface 367 and an inner surface 362, where the inner surface 362 forms a cavity 359 that traverses the length of the dislodging tool 360. Depending on the mechanism used to enable (activate) the dislodging tool 360, the top portion 366 and/or the bottom portion 361 can have one or more additional features. For example, as shown in FIG. 3B, the dislodging tool 360 can be enabled by pressure. In such a case, a user (e.g., a drilling operator) can use the field equipment to raise the pressure within the subterranean wellbore 320 until a threshold pressure is reached, at which time a rupture disk, pressure pocket 363, a piston, or other component or device can mechanically initiate a process that results in the physical separation between the top portion 366 and the bottom portion 361 of the dislodging tool 360.

As another example, the dislodging tool 360 can be enabled by an electrical signal through an electrical cable that is disposed within the subterranean wellbore 320. In some cases, the electrical signals can be transmitted through the drill string 314 and/or the tubing string 324. As yet another example, the dislodging tool 360 can be enabled by wireless communication signals, as through the fluid in the subterranean wellbore 320. The system 800 of FIG. 8 below shows how these latter implementations can be achieved.

The dislodging tool 370 in the form of a jarring tool is an optional part of an example assembly 350. When the dislodging tool 370 is present, it is used as a primary form of recovery of the service tool 207 because, if the dislodging tool 370 succeeds in freeing the service tool 207 from being stuck, then the entire downhole assembly, including the tubing string 314, the BHA 101 (including the service tool 207), and the example assembly 350, can be retrieved. Generally speaking, the dislodging tool 370 applies a downward (gravity-assisted) jarring force to the service tool 207 and other downhole equipment (e.g., the BHA 101) within the subterranean wellbore 320.

The dislodging tool 370 in the form of a jarring tool can have any of a number of components and/or configurations. For example, as shown in FIG. 3C, the dislodging tool 370 can include a top portion 376 and a bottom portion 371 that are movable relative to each other within a range of motion when the dislodging tool 370 is enabled or activated. The bottom of the bottom portion 371 includes a coupling feature 374 (in this case, mating threads) that can couple to another dislodging tool of the assembly 350, the service tool 207, a tubing pipe 315 of the tubing string 314, or some other component of a downhole assembly. Similarly, the top of the top portion 376 includes a coupling feature 375 (in this case, mating threads) that can couple to another dislodging tool of the assembly 350, a tubing pipe 315 of the tubing string 314, or some other component of a downhole assembly.

The top portion 376 and the bottom portion 371 have an outer surface 377 and an inner surface 372, where the inner surface 372 forms a cavity 359 that traverses the length of the dislodging tool 370. The top portion 376 and/or the bottom portion 371 of the dislodging tool 370 can have any of a number of configurations. For example, as shown in FIG. 3C, the top portion 376 includes an arm 379 with a distal extension 378 that is positioned inside of the inner surface 372 of the bottom portion 371. The arm 379 can be a single continuous cylinder or one or more discrete arced segments. Similarly, the distal extension 378 can be continuous around the perimeter of the cavity 359 or one or more discrete segments.

The inner surface 372 of the bottom portion 371 has a recessed area 338 bounded vertically by stop 339 at the bottom and stop 351 on top. The distal extension 378 travels within the recessed area 338, and this range of motion of the distal extension 378 sets the vertical limits that the top portion 376 travels up and down relative to the bottom portion 371 within the subterranean wellbore 320. When the distal extension 378 of the top portion 376 is lifted upward (e.g., indirectly by lifting on the tubing string 314 using field equipment) to the maximum limit (abuts against the bottom of stop 351), kinetic energy is ready to be used.

When the top portion 376 is released (indirectly by releasing the tubing string 314), the top portion 376 falls, assisted by gravity and the mass of the tubing string 314, the distance defined by the length of the recessed area 338 until flange 328 of the top portion 376 slams into the top of stop 351 of the bottom portion 371. This force is translated through the bottom portion 371 of the dislodging tool 370, and through any intervening portions of the downhole assembly, to the service tool 207. The resulting jarring of the service tool 207 is designed to free the service tool 207 from being stuck. The process of operating (enabling) the dislodging tool 370 can be repeated any of a number of times. Enabling the dislodging tool 370 can be performed manually (e.g., by a drilling operator) or automatically (e.g., using a controller, as in FIG. 8 below).

The dislodging tool 380 in the form of a reverse circulation tool is an optional part of an example assembly 350. When the dislodging tool 380 is present, it is used as a primary form of recovery of the service tool 207 because, if the dislodging tool 380 succeeds in freeing the service tool 207 from being stuck, then the entire downhole assembly, including the tubing string 314, the BHA 101 (including the service tool 207), and the example assembly 350, can be retrieved. Generally speaking, the dislodging tool 380 reverses the flow of fluid from a downward direction to an upward direction (toward the surface 102). This reverse flow can serve to loosen at least some of the material that is causing the service tool 207 to be stuck. In addition, or in the alternative, this reverse flow can remove some of the fluid weighing down the downhole assembly, making it easier for the field equipment 130 to lift the service tool 207 free from being stuck within the subterranean wellbore 320.

The dislodging tool 380 in the form of a reverse circulation tool can have any of a number of components and/or configurations. For example, as shown in FIGS. 3D and 3E, the bottom of the dislodging tool 380 includes a coupling feature 384 (in this case, mating threads) that can couple to another dislodging tool of the assembly 350, the service tool 207, a tubing pipe 315 of the tubing string 314, or some other component of a downhole assembly. Similarly, the top of the dislodging tool 380 includes a coupling feature 385 (in this case, mating threads) that can couple to another dislodging tool of the assembly 350, a tubing pipe 315 of the tubing string 314, or some other component of a downhole assembly.

The dislodging tool 380 has housing 337 with an outer surface 387 and an inner surface 382, where the inner surface 382 forms a cavity 359 that traverses the length of the dislodging tool 380. The dislodging tool 370 can have any of a number of configurations. For example, as shown in FIGS. 3D and 3E, the dislodging tool 380 includes one or more reversing ports 381 (also called flowback ports 381), one or more rupture discs 383, one or more seals 329, a collet 352, a piston mandrel 389, and a ratcheting system 388 between the collet 352 and the piston mandrel 389.

The dislodging tool 380 operates by applying annulus pressure (between the outer surface 387 and the casing string 324) to burst the one or more rupture discs 383. When this occurs, the reversing ports 381 are locked open. The ratcheting system 388 keeps the piston mandrel 389 in the closed position until the one or more rupture discs 383 are ruptured. When the one or more rupture discs 383 burst, hydrostatic pressure is applied to the piston mandrel 389, moving it upward within the cavity 359 against a stop. This results in uncovering one or more large circulating ports (not shown in FIG. 3D or 3E) for reversing the flow of the fluid. Once annulus pressure pushes the piston mandrel 389 upward, the ratcheting system 388 locks the piston mandrel 389 in place to keep the reversing ports 381 open.

With the circulating ports open, the subterranean wellbore 320 can be reverse circulated clean by pumping fluids down the annulus 323, through the circulating ports, and up the cavity (e.g., cavity 113) of the tubing string 314. The process of operating (enabling) the dislodging tool 380 can be repeated any of a number of times. In other words, the flow of fluid through and around the dislodging tool 380 can be reversed and returned to normal any of a number of times, where alternating between flow and counter-flow can loosen an area causing the service tool 207 to be stuck. Enabling the dislodging tool 380 can be performed manually (e.g., by a drilling operator) or automatically (e.g., using a controller, as in FIG. 8 below).

While the assembly 350 in FIGS. 3A through 3E shows multiple dislodging tools, and those dislodging tools are consecutively coupled to each other, in other example embodiments an assembly 350 having multiple dislodging tools can be physically separated from each other. For example, one or more tubing pipes (e.g., tubing pipes 125) and/or the service tool 207 can be disposed between one dislodging tool (e.g., dislodging tool 360) and another dislodging tool (e.g., dislodging tool 370). Also, when an example assembly 350 includes multiple dislodging tools, there can be any order to the dislodging tools of the assembly 350. Further, an example assembly 350 with multiple dislodging tools can include two or more of the same dislodging tools (e.g., dislodging tool 370 in the form of a jarring tool). In alternative embodiments, there can be multiple assemblies 350 integrated at different locations along a wellbore assembly.

Figure 4A:
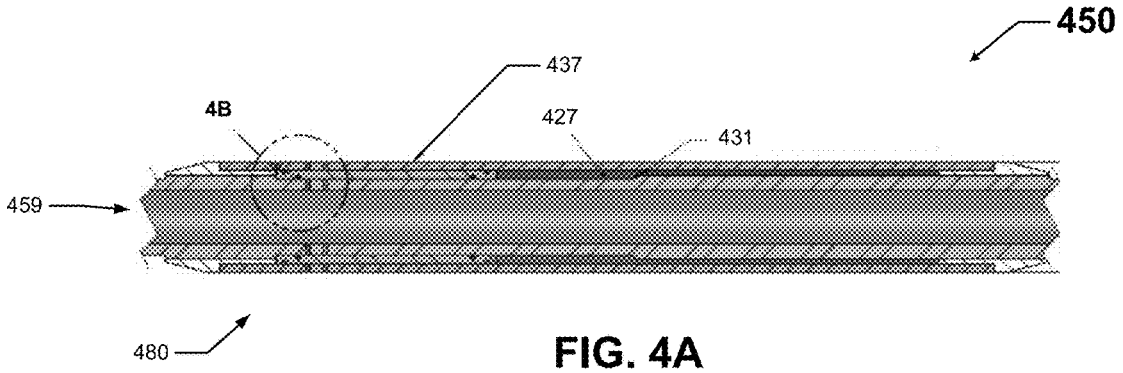
FIGS. 4A and 4B shows various cross-sectional side views of an assembly in accordance with certain example embodiments.
Figure 4B:
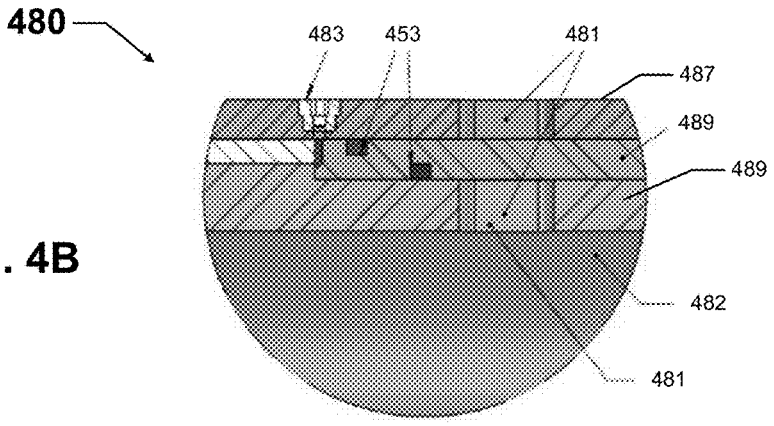

FIGS. 4A and 4B shows various cross-sectional side views of an assembly 450 in accordance with certain example embodiments. Specifically, FIG. 4A shows a cross-sectional side view of the assembly 450, and FIG. 4B shows a detailed view of a portion of the assembly 450 of FIG. 4A. Referring to FIGS. 1 through 4B, the example assembly 450 in this case includes dislodging tool 480 in the form of a reverse circulation tool, shown in a closed position. Unless otherwise expressly stated below, the various components of the assembly 450 of FIGS. 4A and 4B are substantially the same as the corresponding components of the example assemblies discussed above with respect to FIGS. 1 and 3A through 3E.

For example, dislodging tool 480 of the assembly 450 of FIGS. 4A and 4B includes a piston mandrel 489 that is movable within a slot 427 in the wall of the housing 437. In the closed position, the piston mandrel 489 is positioned adjacent to at least one rupture disc 483 (disposed between the outer surface 487 of the wall of the housing 437 and the slot 427 in the wall of the housing 437) and covers at least one reversing port 481 that traverses the entire wall (including the slot 427) of the housing 437. The piston mandrel 489 includes a number of seals 453 to prevent fluid from flowing through the reversing ports 481 in either direction when the piston mandrel 489 is in the closed position.

In this case, rather than using a collet and ratcheting system, as with the dislodging tool 380 of FIGS. 3D and 3E above, the dislodging tool 480 of the assembly 450 of FIGS. 4A and 4B includes a pressurized gas (e.g., nitrogen) disposed within the slot 427 between the piston mandrel 489 and the stop 431. This pressurized gas serves as a type of compressible spring that keeps the piston mandrel 489 in the closed position until the rupture disc 483 ruptures, in which case the pressure (e.g., 20 kpsi) from the fluid in the annulus (e.g., annulus 323) overcomes the pressure of the gas in the slot 427, forcing the piston mandrel 489 toward or against the stop 431. When the piston mandrel 489 uncovers the reversing ports 481 moving from the closed position to the open position, the fluid from the annulus flows through the reversing ports 481, and then up the cavity 459 toward the surface (e.g., surface 102).

The design of the dislodging tool 480 of the assembly 450 of FIGS. 4A and 4B can also be used as a single-use jarring tool. Specifically, the set point of the rupture disc 483 and the pressure of the gas in the slot 427 can be set at a level that allows the piston mandrel 489 to impact the stop 431 hard enough to drive an impulse of energy upward along the downhole assembly. The assembly 450 can include multiples of such dislodging tools 480, where each dislodging tool 480 has a different set point of the rupture disc 483 and/or pressure of the gas in the slot 427 to allow for staged (e.g., sequential) jarring of the downhole assembly in addition to an increased amount of reverse flow of fluid to the surface.

Figure 5A:
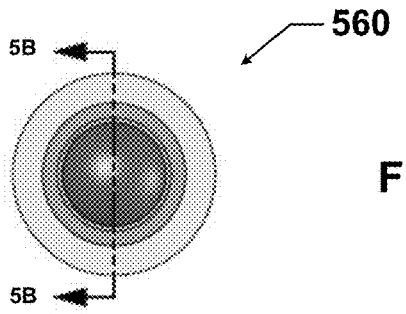
FIGS. 5A through 5C show various views of a dislodging tool of an assembly in accordance with certain example embodiments.
Figure 5B:
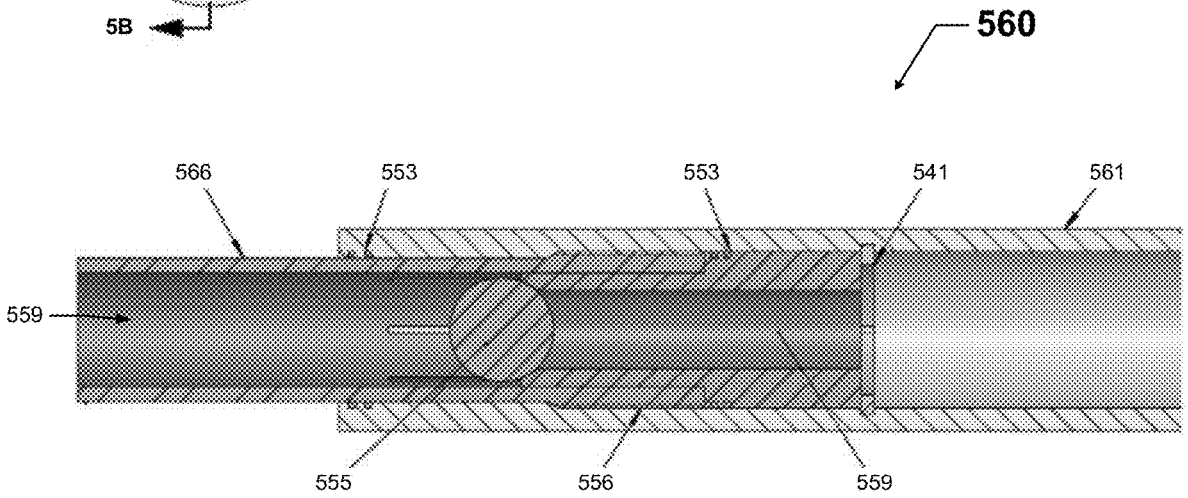
Figure 5C:
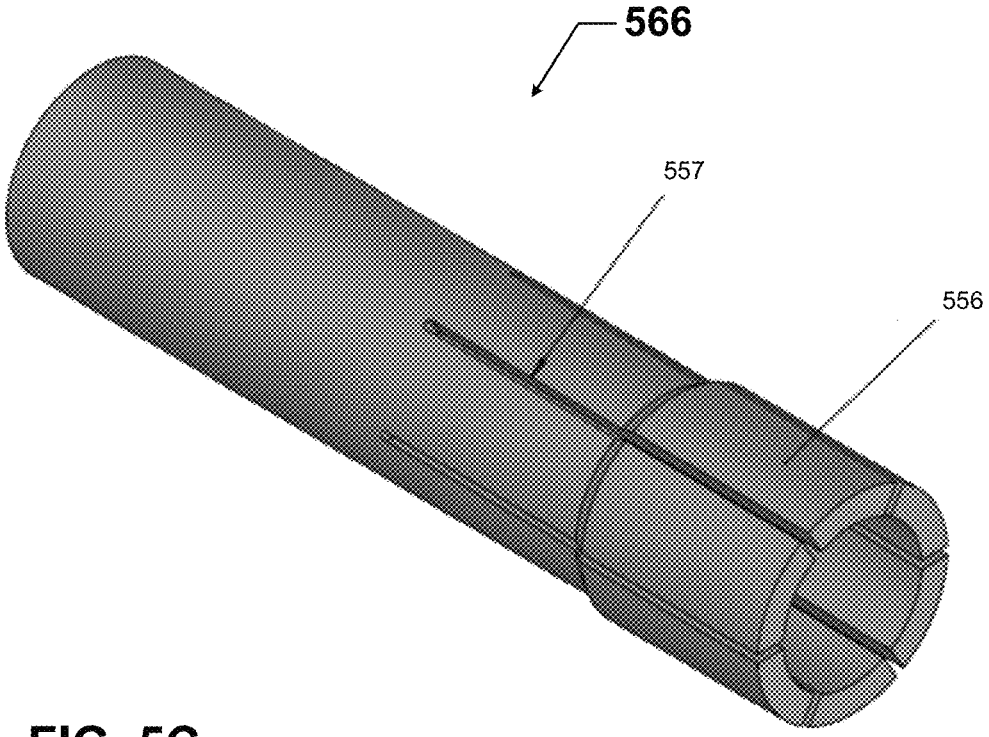

FIGS. 5A through 5C show various views of a dislodging tool 560 of an assembly in accordance with certain example embodiments. Specifically, FIG. 5A shows a top view of the dislodging tool 560. FIG. 5B shows a cross-sectional side view of the dislodging tool 560. FIG. 5C shows a perspective view of the top portion 566 of the dislodging tool 560. The dislodging tool 560 in this case is in the form of a disconnect tool. Referring to FIGS. 1 through 5C, the dislodging tool 560 of FIGS. 5A through 5C can be substantially similar to the dislodging tool 360 of FIGS. 3A and 3B above, except as described below.

The dislodging tool 560 of FIGS. 5A through 5C includes a top portion 566, a bottom portion 561, a shifting sleeve 559 disposed between the top portion 566 and the bottom portion 561, and a shear disk 541 that abuts against the distal end of the shifting sleeve 559. The top portion 566 has a distal end 556 that is collapsible because of a number of slots 557 that traverse the body of the top portion 566 along at least part of the length of the top portion 566. In some cases, there are one or more coupling features (e.g., mating threads) disposed on the outer surface of the distal end 556 of the top portion 566 to allow the top portion 566 to be coupled to a complementary coupling feature disposed on the inner surface of the bottom portion 561.

To enable (activate) the dislodging tool 560, a ball 555 is dropped down the cavity (e.g., cavity 113) of the tubing string (e.g., tubing string 114) from the surface (e.g., surface 102). The ball 555 can be made of any of a number of materials (e.g., stainless steel, rubber, nylon). The ball 555 can have an outer diameter that is less than the inner diameter of the cavity 559 of the top portion 566 of the dislodging tool 560, which is no greater than the inner diameter of the tubing string at any point along the downhole assembly.

The ball 555 passes through the cavity 559 formed by the top portion 566, and then comes to rest against the proximal end (the top) of the shifting sleeve 559, which has an inner diameter that is less than the outer diameter of the ball 555. When this occurs, the ball 555 greatly reduces or stops the flow of the fluid through the cavity 559 of the shifting sleeve 559 and down through the remainder of the downhole assembly. As a result, the fluid above the ball 555 imposes a large amount of force against the ball 555, which translates to a large amount of force applied by the shifting sleeve 559 against the shear disk 541. When the force applied by the shifting sleeve 559 against the shear disk 541 is greater than a threshold value that triggers the shear disk 541, then the shear disk 541 activates, physical severing the wall of the bottom portion 561 adjacent to the location of the shear disk 541.

Figure 6A:
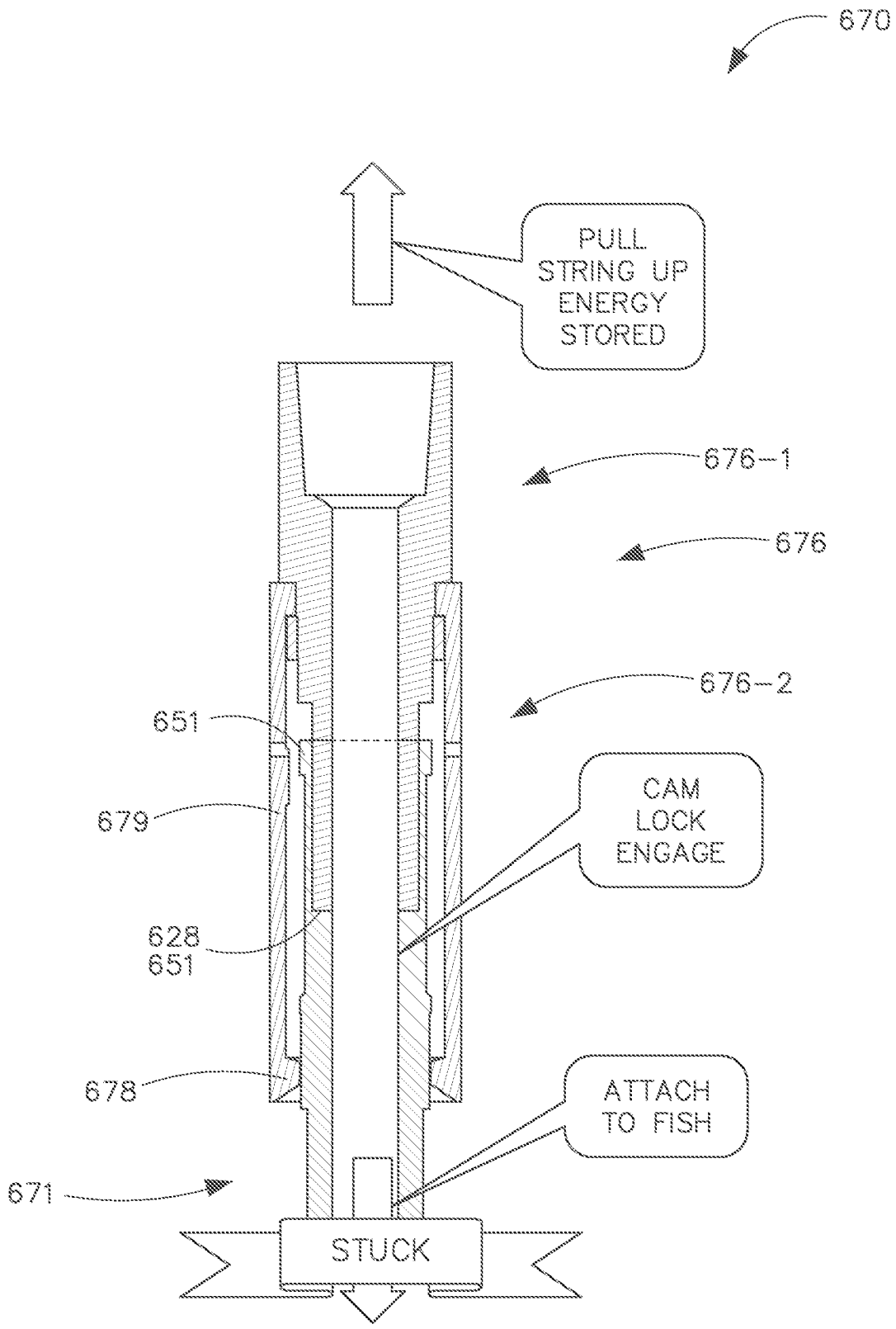
FIGS. 6A and 6B show various views of another dislodging tool of an assembly in accordance with certain example embodiments.
Figure 6B:
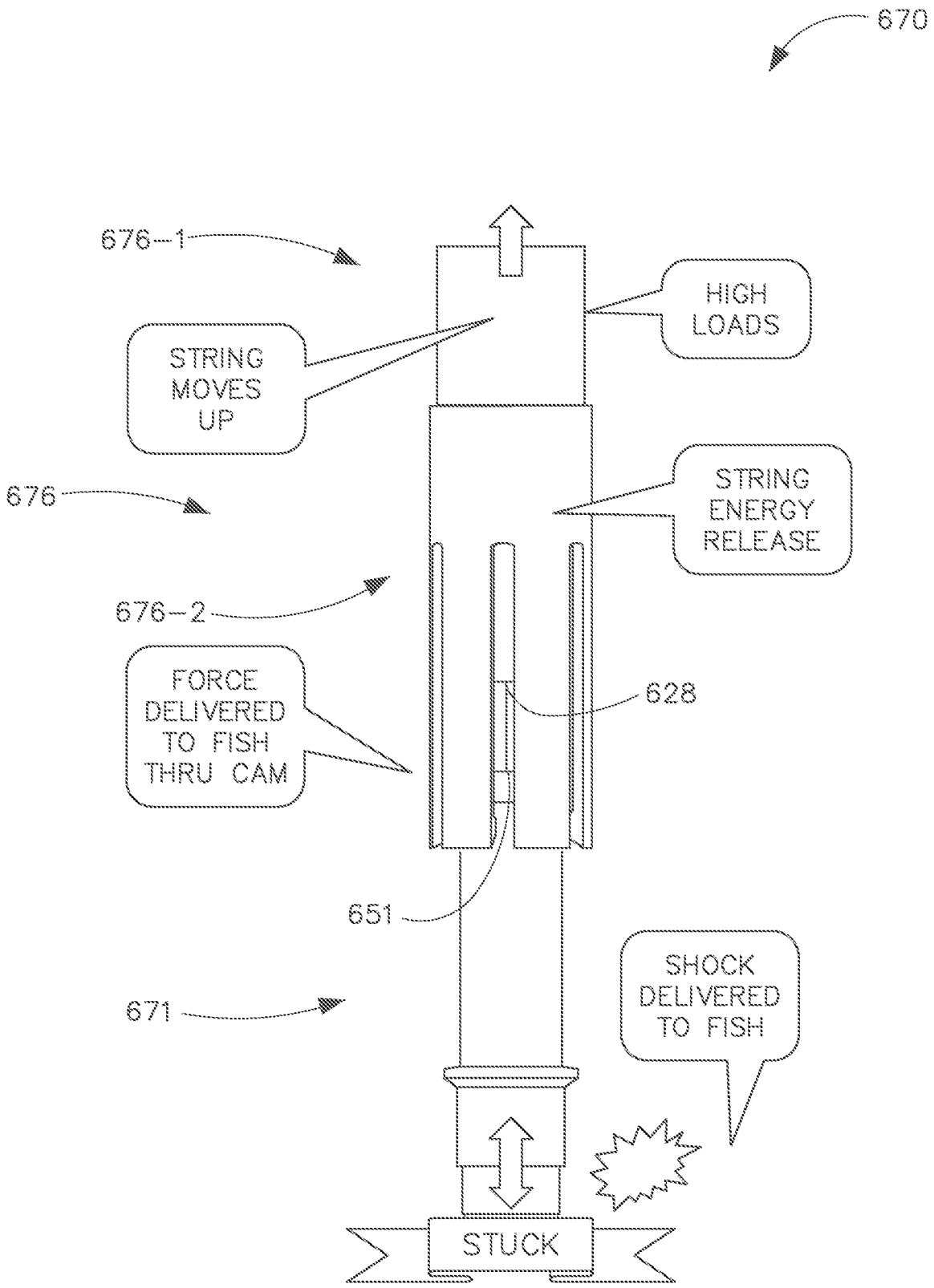

FIGS. 6A and 6B show various views of another dislodging tool 670 of an assembly in accordance with certain example embodiments. Specifically, FIG. 6A shows a cross-sectional side view of the dislodging tool 670 in a natural state. FIG. 6B shows a side view of the dislodging tool 670 in an activated state. The dislodging tool 670 of FIGS. 6B and 6B can be substantially the same as the dislodging tool 370 of FIG. 3C, except as described below.

Referring to FIGS. 1 through 6B, the dislodging tool 670 of FIGS. 6A and 6B is in the form of a jarring tool. If the dislodging tool 670 succeeds in freeing a service tool (e.g., service tool 207) from being stuck, then the entire downhole assembly, including the tubing string, the BHA (including the service tool), and the example assembly of which the dislodging tool 670 is a part, can be retrieved. Generally speaking, the dislodging tool 670 applies a downward (gravity-assisted) jarring force to the service tool (referred to as a fish in FIGS. 6A and 6B) and other downhole equipment (e.g., the BHA) within the subterranean wellbore (e.g., subterranean wellbore 320).

As stated above, the dislodging tool 670 in the form of a jarring tool can have any of a number of components and/or configurations. For example, in this case, the dislodging tool 670 can include a top portion 676 and a bottom portion 671 (also referred to as a cam in FIGS. 6A and 6B) that are movable relative to each other within a range of motion when the dislodging tool 670 is enabled or activated. The top portion 676 in this case has multiple parts. Specifically, the top portion 676 includes part 676-1 and part 676-2, which are fixedly coupled to each other. Part 676-2 of the top portion 676 includes an arm 679 with a distal extension 678 that is positioned outside of the outer surface of the bottom portion 671. The arm 679 can be a single continuous cylinder or one or more discrete arced segments. Similarly, the distal extension 678 can be continuous around the perimeter of the cavity traversing the length of the dislodging tool 670 or one or more discrete segments.

The outer surface of the bottom portion 671 has a stop 651 that protrudes outward from its outer surface and sets the vertical limit that the top portion 676 travels up relative to the bottom portion 671. When the distal extension 678 of the part 676-2 of the top portion 676 is lifted upward (e.g., indirectly by lifting on the tubing string (e.g., tubing string 314) using field equipment (e.g., field equipment 130) to the maximum limit (abuts against the bottom of stop 651), as shown in FIG. 6B, kinetic energy is ready to be used.

When the top portion 676 is released (indirectly by releasing the tubing string), the top portion 676 falls, assisted by gravity and the mass of the tubing string, until flange 628 of the top portion 676 slams into the top of stop 651 of the bottom portion 671. This force is translated through the bottom portion 671 of the dislodging tool 670, and through any intervening portions of the downhole assembly, to the service tool. The resulting jarring of the service tool is designed to free the service tool from being stuck. The process of operating (enabling) the dislodging tool 670 can be repeated any of a number of times. Enabling the dislodging tool 670 can be performed manually (e.g., by a drilling operator) or automatically (e.g., using a controller, as in FIG. 8 below).

Figure 7:
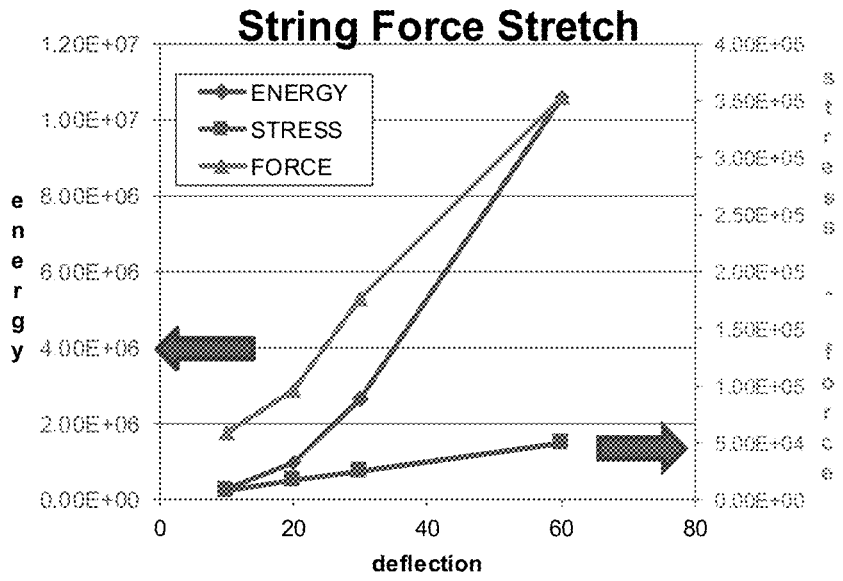
FIGS. 7 and 8 show graphs of the effectiveness of the dislodging tool of FIGS. 6A and 6B.
Figure 8:
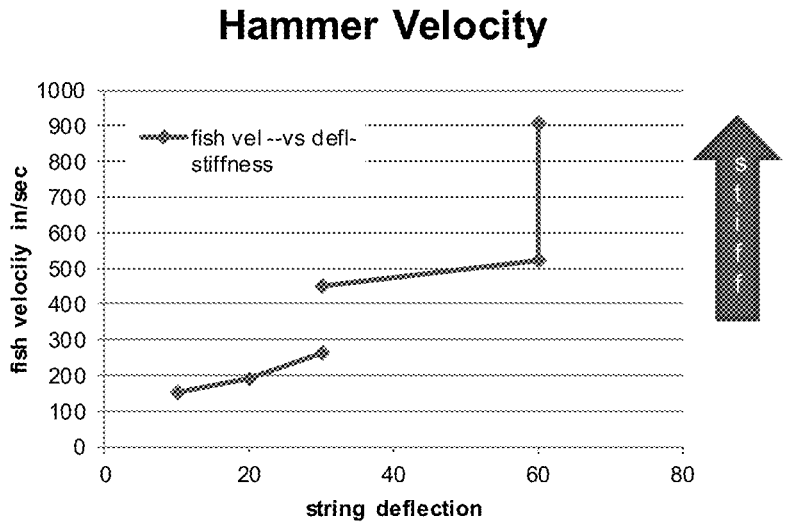

FIGS. 7 and 8 show graphs of the effectiveness of the dislodging tool 670 of FIGS. 6A and 6B. Specifically, graph 791 of FIG. 7 shows the energy, stretch, and force that can be realized when the dislodging tool 670 of FIGS. 6A and 6B is enabled. Graph 892 of FIG. 8 shows the velocity of the top portion 676 just before the top portion 676 jars (strikes against) the bottom portion 671 of the dislodging tool 670 of FIGS. 6A and 6B.

Figure 9C:
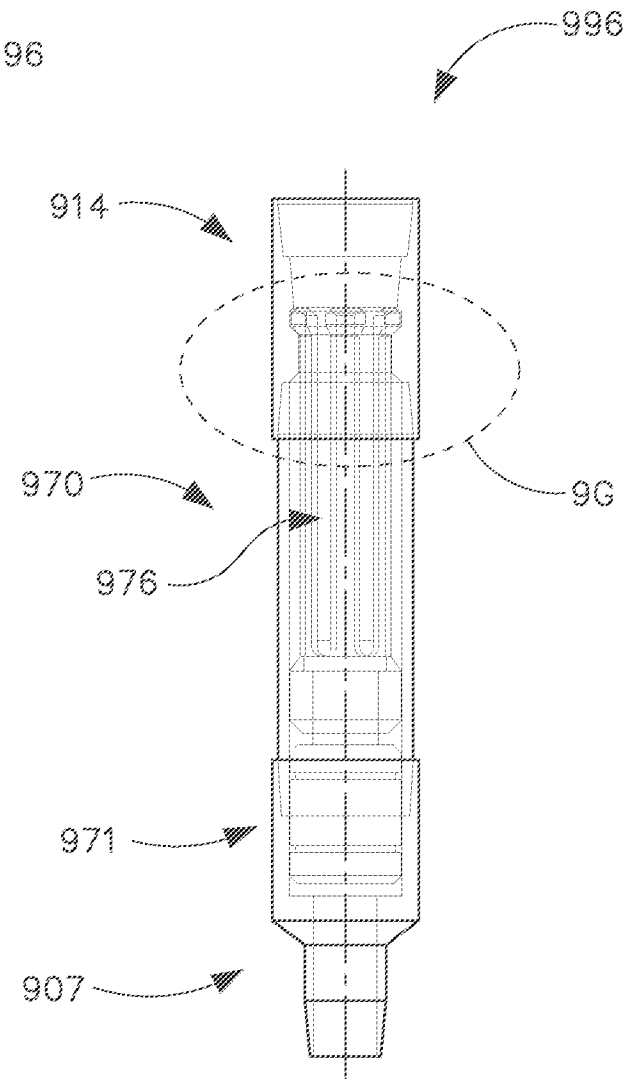
FIGS. 9A through 9O show various views of yet another subassembly in accordance with certain example embodiments.
Figure 9B:
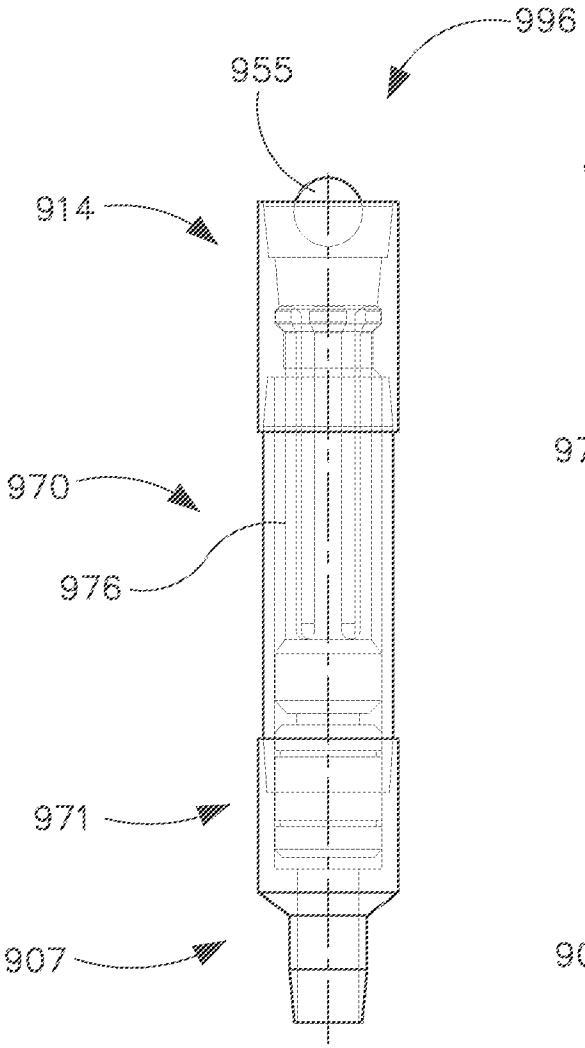
Figure 9A:
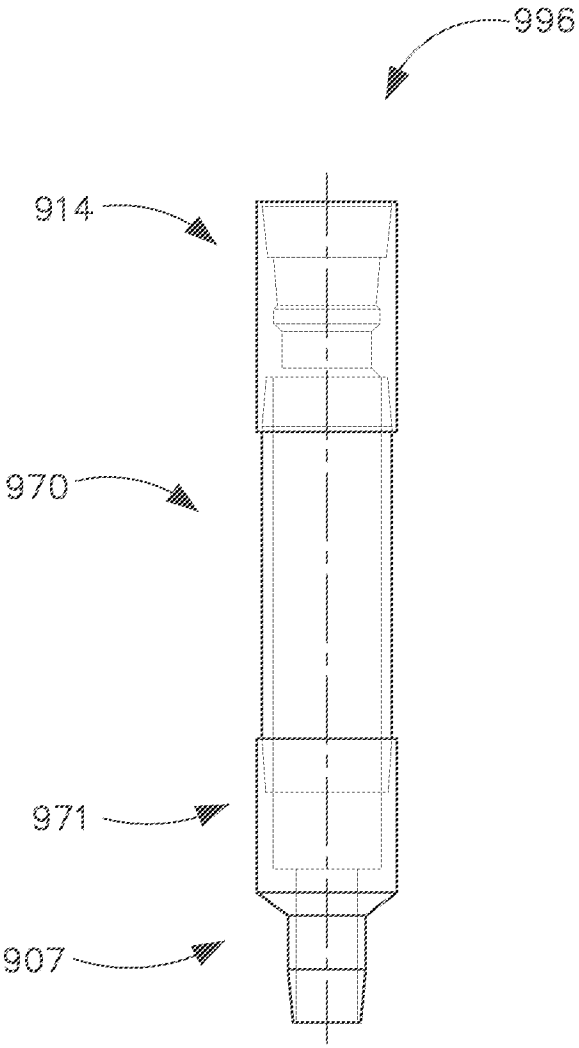
Figure 9E:
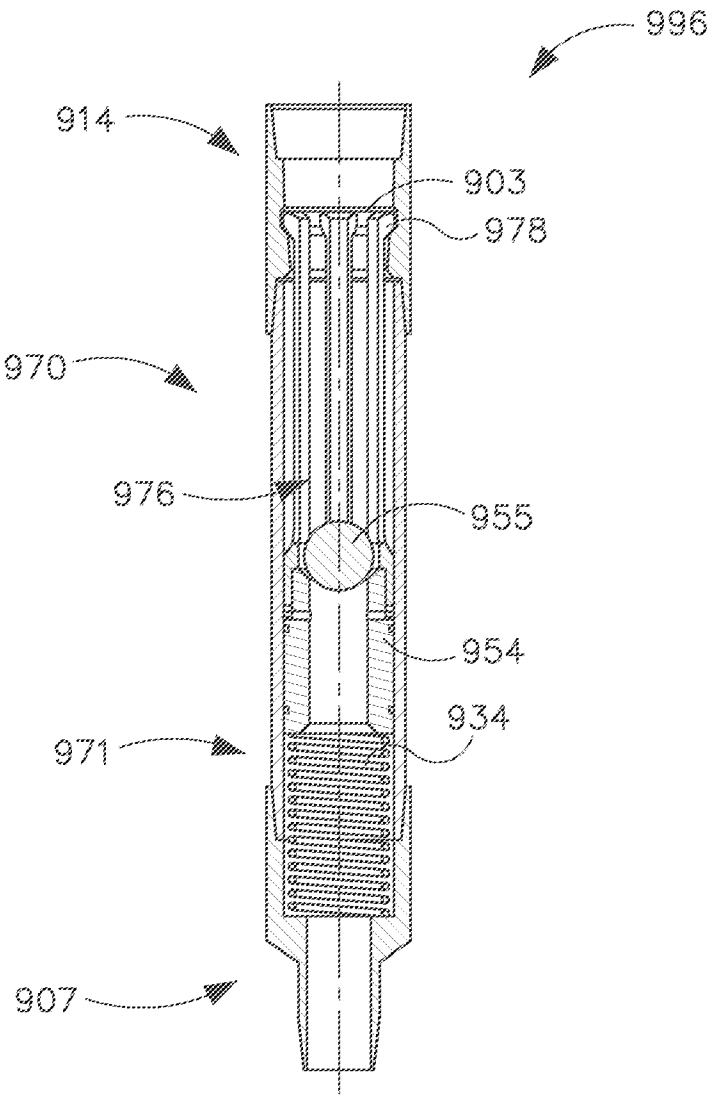
Figure 9D:
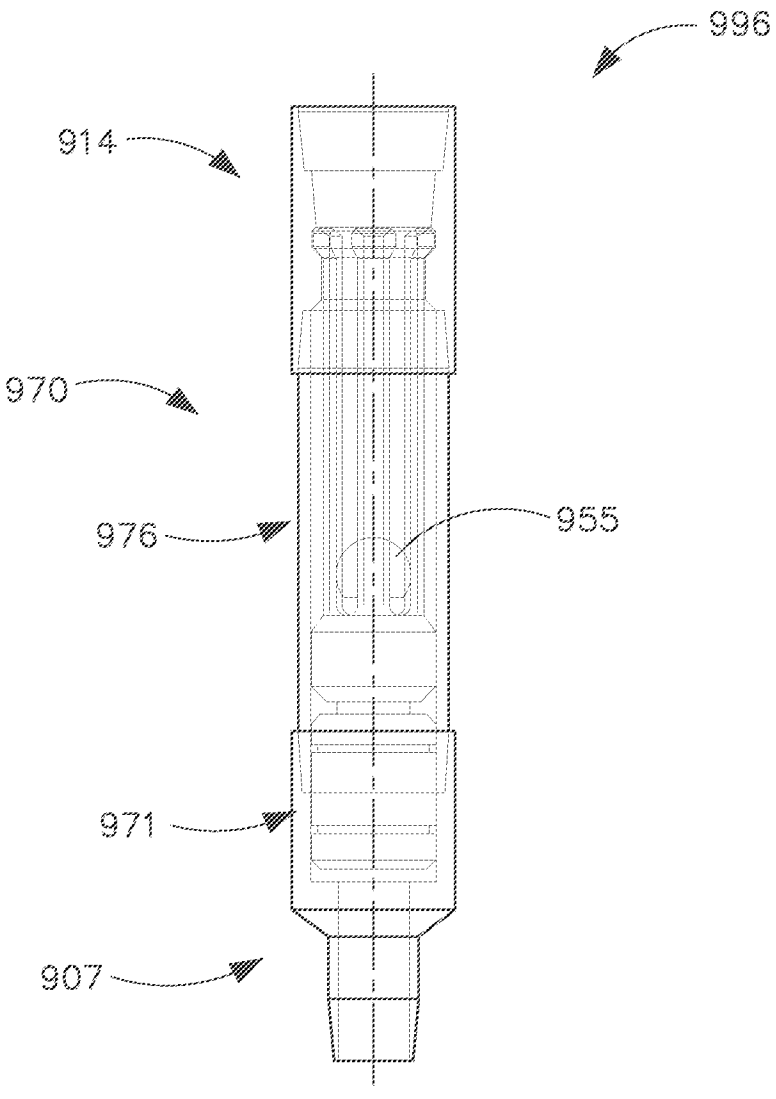
Figure 9H:
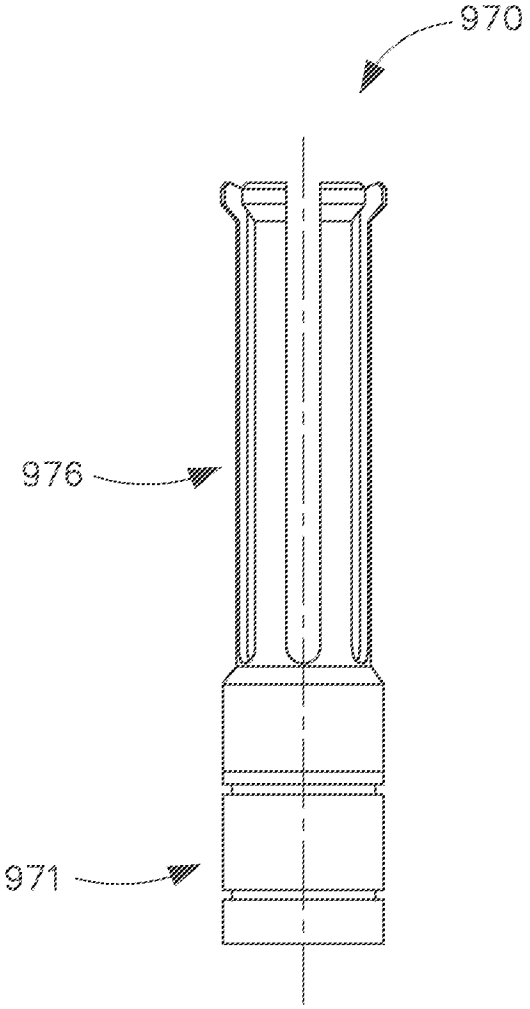
Figure 9G:
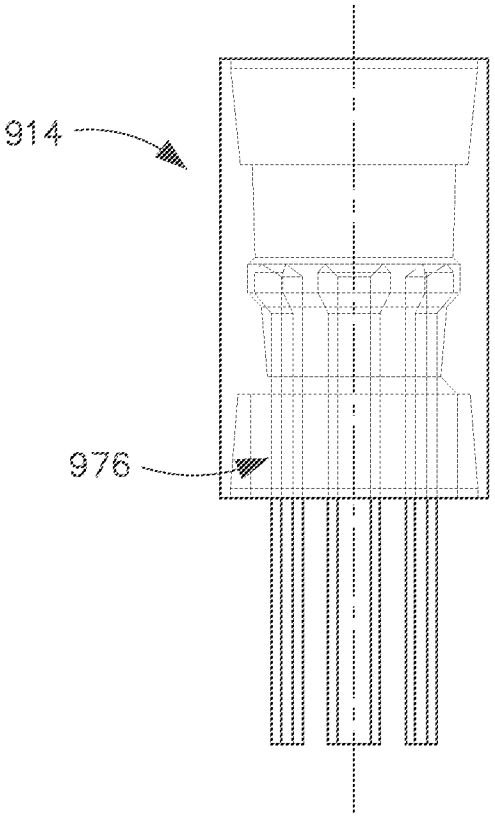
Figure 9F:
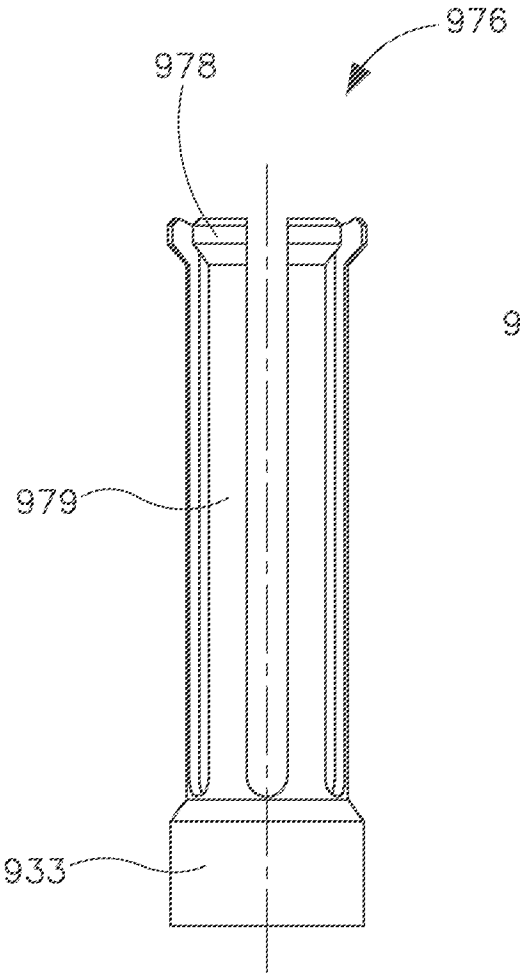
Figure 9K:
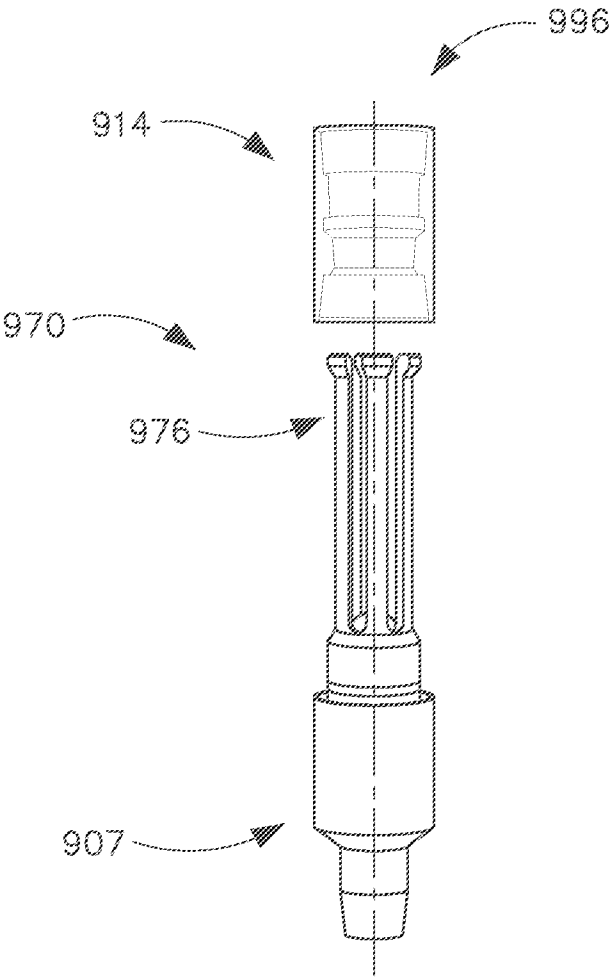
Figure 9J:
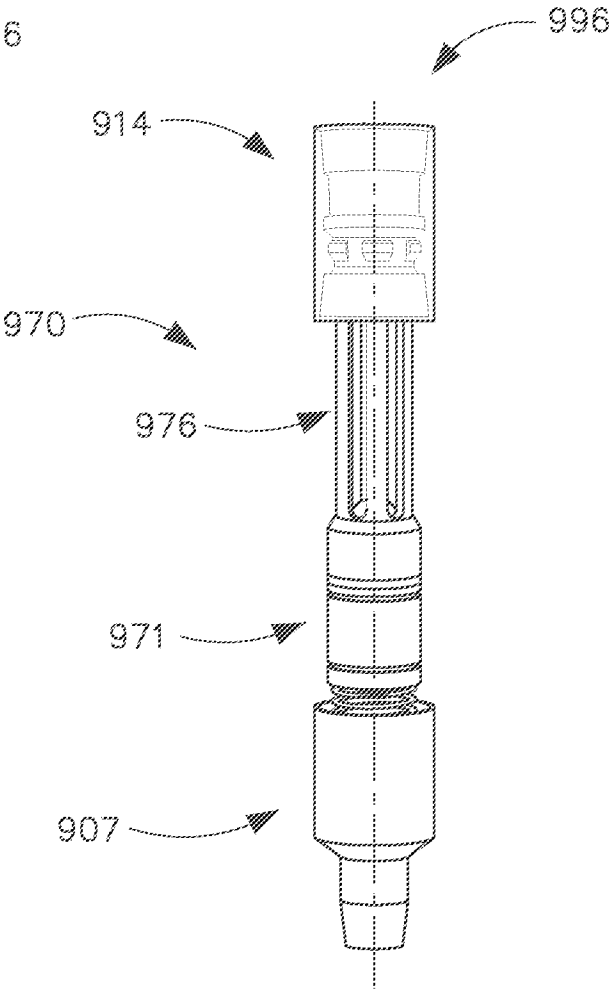
Figure 9I:
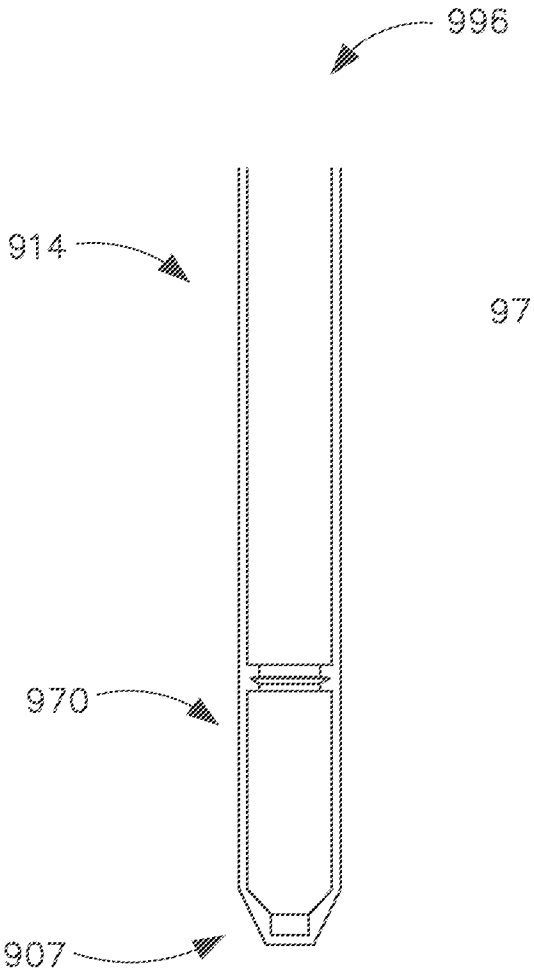
Figure 9M:
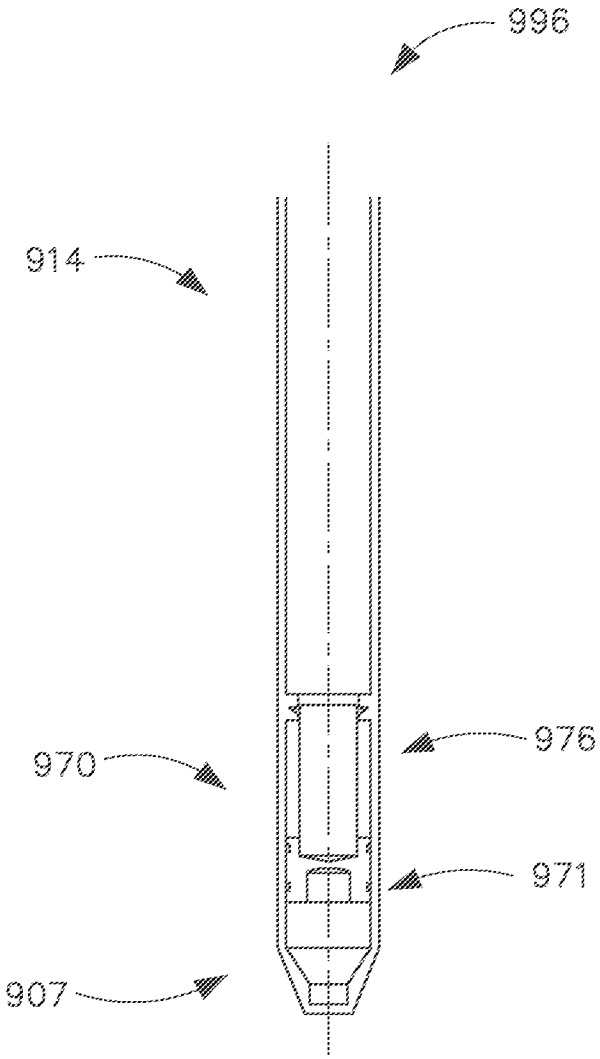
Figure 9L:
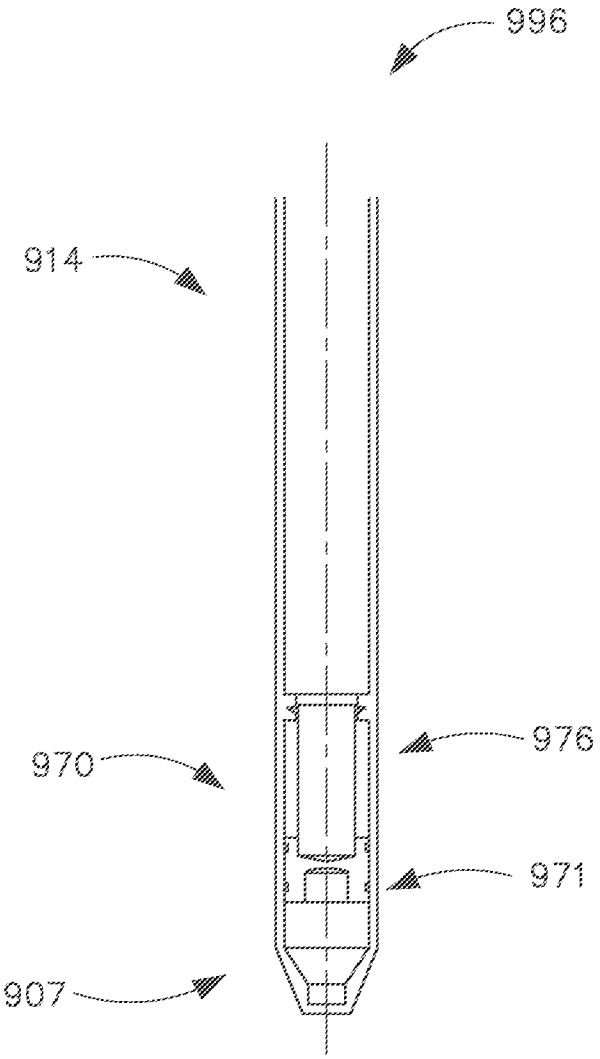
Figure 9O:
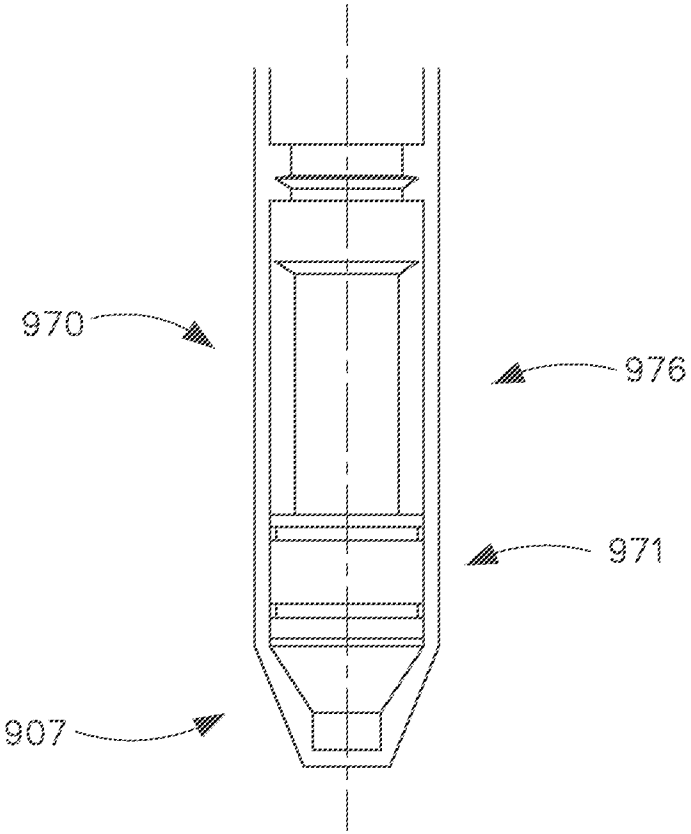

FIGS. 9A through 9O show various views of another subassembly 996 that includes a dislodging tool 970 in accordance with certain example embodiments. Specifically, FIGS. 9A through 9D show semi-transparent side views of the subassembly 996. FIG. 9E shows a cross-sectional side view of the subassembly 996. FIG. 9F shows a side view of the top portion 976 (also sometimes called the jar 976) of the dislodging tool 970. FIG. 9G shows a detailed semi-transparent side view of part of FIG. 9C. FIG. 9H shows a side view of the dislodging tool 970. FIG. 9I shows a side view of a simplistic schematic of the subassembly 996. FIG. 9J shows a side view of the subassembly 996 when the extensions 978 are engaged with the recess 903.

Figure 9N:
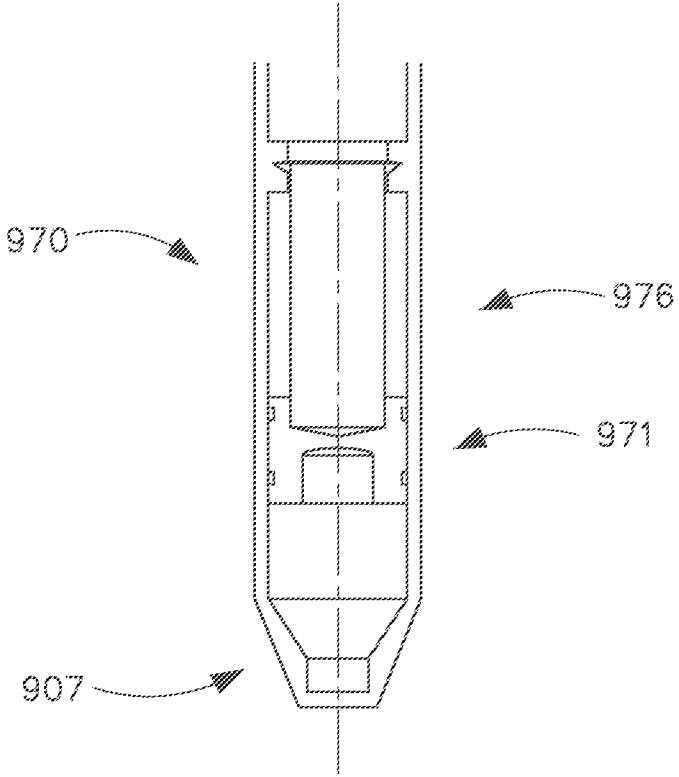

FIG. 9K shows a side view of the subassembly 996 when the extensions 978 are disengaged from the recess 903. FIG. 9L shows a side view of the subassembly 996 when the tubing string 914 is preloaded. FIG. 9M shows a side view of the subassembly 996 when the ball 955 abuts against the top of the piston 954 and induced loading is reacted at the recess 903. FIG. 9N shows a side view of the subassembly 996 when the extensions 978 are engaged with the recess 903. FIG. 9O shows a side view of the subassembly 996 when the extensions 978 are disengaged from the recess 903.

Referring to FIGS. 1 through 9O, the various components of the subassembly 996 of FIGS. 9A through 9O can be substantially the same as the corresponding components discussed above with respect to FIGS. 1 through 8, except as described below. The subassembly 996 of FIGS. 9A through 9O includes the dislodging tool 970 connected at the top end to a tubing string 914 and at the bottom end to a service tool 907. In some cases, the service tool 907 can be located some distance (e.g., 30 feet, 60 feet) below the dislodging tool 970. The dislodging tool 970 includes the top portion 976 and the bottom portion 971, where the top portion 976 moves relative to the bottom portion 971.

In this case, the top portion 976 of the dislodging tool 970 includes a base 933, above which extend arms 979. At the distal end of each arm 979 is an extension 978 that extends laterally outward from the arm 979. The extensions 978 (sometimes called hooks) are designed to be disposed within a recess 903 along an inner surface of the distal end of the tubing string 914. Along the inner surface of the base 933 is a movable piston 954, at the top of which is a configuration to support a ball 955 that is dropped through the cavity of the tubing string 914 from the surface (e.g., surface 102). The bottom portion 971 of the dislodging tool 970 contains a resilient device 934 (in this case, a compression spring), the top end of which abuts against the bottom of the base 933 of the top portion 976.

The configuration of the dislodging tool 970 of FIGS. 9A through 9O is designed for a more controlled jarring action (less violent, thereby causing less wear and tear on the downhole assembly or portions thereof when attempting to free the service tool 907 when the service tool 907 is stuck. The configuration of the dislodging tool 970 also has other benefits, including but not limited to moderate jar loads, a repeatable jarring action (reloadable), safe until actuated, ability to maintain a preload on the tubing string 914, requires only a minimal pressure rise in the subterranean wellbore, pressure on the tubing string 914 can be maintained during actuation of the dislodging tool 970, the extensions 978 and/or arms 979 of the top portion 976 can be specifically designed and interchangeable for a particular wellbore, jarring can be repeated by reloading the resilient device 934 or changing the pressure in the wellbore, the ball 955 is dropped down the cavity of the tubing string 914 to actuate the dislodging tool 970, the dislodging tool 970 can be actuated without having the tubing string 914 in tension, flow into the reservoir is limited, and there is a lack of load on the service tool 907 until actuation because the top portion 976 is directly coupled to the tubing string 914.

As stated above, to actuate the dislodging tool 970, the ball 955 is dropped down the cavity of the tubing string 914 from the surface, which creates a seal at the top of the piston 954. Strain energy is captured by the tensioning of the extensions 978 and/or arms 979 of the top portion 976 while the extensions 978 are engaged with the tubing string 914. A load can be applied by the piston 954, which is actuated hydraulically. Pressure in the wellbore can be adjusted at the surface. Once a threshold tension is applied to the extensions 978 and/or arms 979 of the top portion 976 while the extensions 978 are engaged with the tubing string 914, the extensions 978 deflect and are released from the recess 903 of the tubing string 914, which initiates the jarring action of the top portion 976 against the bottom portion 971.

For example, tension can be created in the tubing string 914 by pulling up on the tubing string 914 to a neutral (unloaded) weight of the tubing string plus some amount of preload (e.g., 50 k pounds). To actuate the jarring, the pressure in the subterranean wellbore (e.g., 30 k feet) can be increased to 1 k psi, a load of 14 k pounds can be added, which also adds 2-3 barrels of capacity, and adding about 2.5 feet in the length of the tubing string 914. When the extensions 978 become disengaged from the recess 903, a jarring impact results, but at a reduced pressure drop relative to the other embodiments of a dislodging tool in the form of a jarring tool discussed above.

Figure 10:
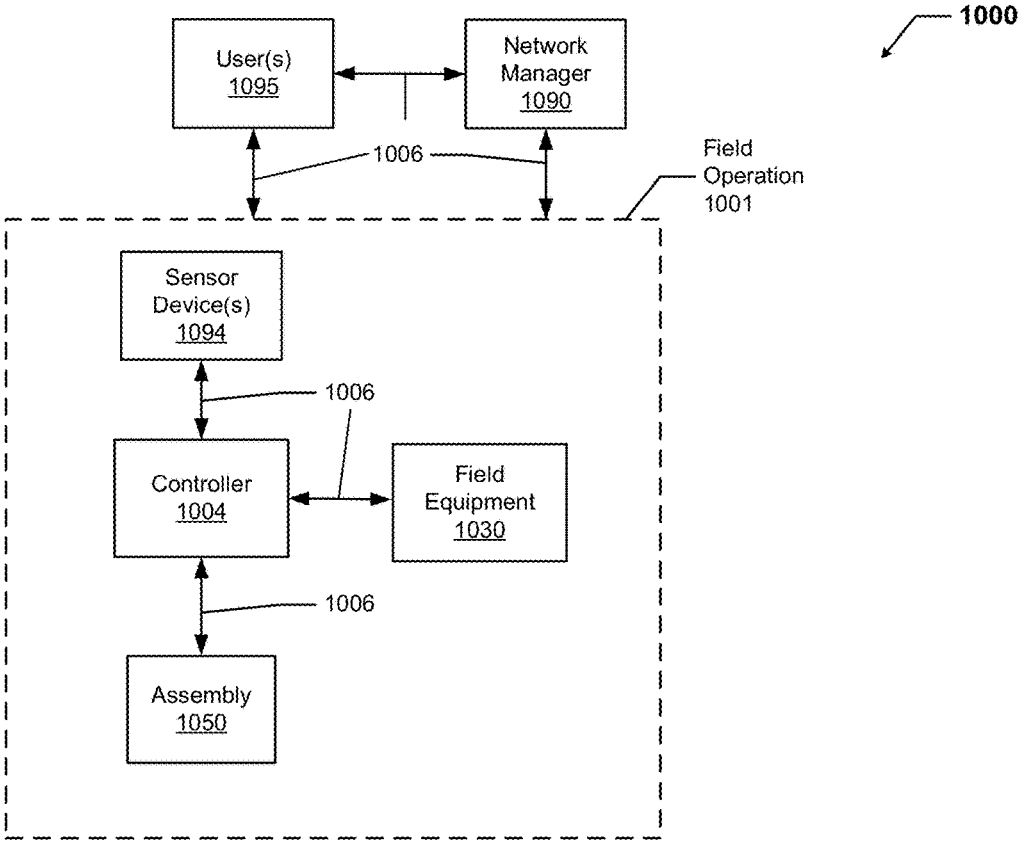
FIG. 10 shows a system diagram of a system in accordance with certain example embodiments.

FIG. 10 shows a system diagram of a system 1000 in accordance with certain example embodiments. Referring to FIGS. 1 through 10, the system 1000 can include one or more components. For example, as shown in FIG. 10, the system 1000 can include one or more sensor devices 1094 (also sometimes called sensor modules 1060), one or more users 1095, a network manager 1090, a controller 1004, field equipment 1030, and one or more assemblies 1050. The users 1095, the field equipment 1030, and the assemblies 1050 are substantially the same as the users, the field equipment, and the example assemblies discussed above. The sensor devices 1094, the controller 1004, the field equipment 1030, and the assembly 1050 can be part of a field operation 1001.

The network manager 1090 is a device or component that controls all or a portion of the system 1000 that includes the controller 1004. The network manager 1090 can be substantially similar to the controller 1004 in terms of components and/or functionality. Alternatively, the network manager 1090 can include one or more of a number of features in addition to, or altered from, the features of the controller 1004. There can be more than one network manager 1090 and/or one or more portions of a network manager 1090. In some cases, a network manager 1090 can be called by a number of other names known in the art, including but not limited to an insight manager, a master controller, a network controller, and a gateway.

The various components of the system 1000 can communication with each other using communication links 1006. Each communication link 1006 can include wired (e.g., Class 1 electrical cables, Class 2 electrical cables, electrical connectors, Power Line Carrier, RS485) and/or wireless (e.g., Wi-Fi, visible light communication, cellular networking, Bluetooth, Bluetooth Low Energy (BLE), ultra-wideband (UWB), Zigbee) technology. The communication links 1006 can transmit signals (e.g., power signals, communication signals, control signals, data) between two or more components of the system 1000. For example, the controller 1004 of the system 1000 can interact with the assembly 1050 by transmitting communication signals (e.g., instructions, data, control) over one or more communication links 1006.

The communication signals transmitted over the communication links 105 are made up of bits of data. As described herein, the communication signals can be one or more of any type of signal, including but not limited to RF signals, infrared signals, visible light communication, pressure waves (through the fluid in the wellbore), and sound waves. In some cases, communication links 1006 between the controller 1004 and the assembly 1050 can include, but are not limited to, the casing string (e.g., casing string 124), the tubing string (e.g., tubing string 114), an electrical cable, and fluid circulated down the cavity of the tubing string and up the annulus within the wellbore.

Each of the one or more sensor devices 1094 can include any type of sensing device that measures one or more parameters. Examples of types of sensors of a sensor device 1094 can include, but are not limited to, a pressure sensor, a passive infrared sensor, a photocell, an air flow monitor, a gas detector, a hydrocarbon analyzer, and a temperature detector. Examples of a parameter that is measured by a sensor of a sensor device 1094 can include, but are not limited to, pressure in the wellbore (e.g., wellbore 120), a temperature, a level of gas, a level of humidity, contents of fluid, and a pressure wave.

In some cases, the parameter or parameters measured by a sensor device 1094 can be used by the controller 1004 to operate the field equipment 1030 and/or a portion (e.g., a valve, an actuator, a shearing device) of the assembly 1050. A sensor device 1094 can be an integrated sensor. An integrated sensor has both the ability to sense and measure at least one parameter and the ability to communicate with another component (e.g., the controller 1004) of the system 1000. The communication capability of a sensor device 1094 that is an integrated sensor can include one or more communication devices that are configured to communicate with one or more other components of the system 1000.

In some cases, an integrated sensor device 1094 can include more than one transmitter and/or more than one receiver. This would allow the integrated sensor device 1094 to broadcast to multiple components of the system 1000 using different communication protocols and/or technology. Each sensor device 1094 can use one or more of a number of communication protocols. This allows a sensor device 1094 to communicate with one or more components of the system 1000. The communication capability of a sensor device 1094 that is an integrated sensor can be dedicated to the sensor device 1094 and/or shared with the controller 1004. When the system 1000 includes multiple integrated sensor devices 1094, one integrated sensor device 1094 can communicate, directly or indirectly, with one or more of the other integrated sensor devices 1094 in the system 1000.

If the communication capability of a sensor device 1094 that is an integrated sensor is dedicated to the sensor device 1094, then the sensor device 1094 can include one or more components (e.g., a transceiver, a communication module), or portions thereof, that are substantially similar to the corresponding components described below with respect to the controller 1004. In certain example embodiments, a sensor device 1094 can include an energy storage device (e.g., a battery) that is used to provide power, at least in part, to some or all of the other components of the sensor device 1094. The optional energy storage device of the sensor module 1094 can operate at all times or when the main source of power supplying the sensor device 1094 is interrupted.

Further, a sensor device 1094 can utilize or include one or more components (e.g., memory, storage repository, transceiver) found in the controller 1004. In such a case, the controller 1004 can provide the functionality of these components used by the sensor device 1094. Alternatively, the sensor device 1094 can include, either on its own or in shared responsibility with the controller 1004, one or more of the components of the controller 1004. In such a case, the sensor device 1094 can correspond to a computer system as described below with regard to FIG. 11.

The controller 1004 of the system 1000 can include one or more of a number of components. Such components, can include, but are not limited to, a control engine, a communication module, a timer, a power module, a storage repository (for storing items such as, but not limited to, protocols, algorithms, threshold values, tables, user preferences, settings, historical data, forecasts, and instructions), a hardware processor, a memory, a transceiver, an application interface, and a security module. The controller 1004 can correspond to a computer system as described below with regard to FIG. 11.

Figure 11:
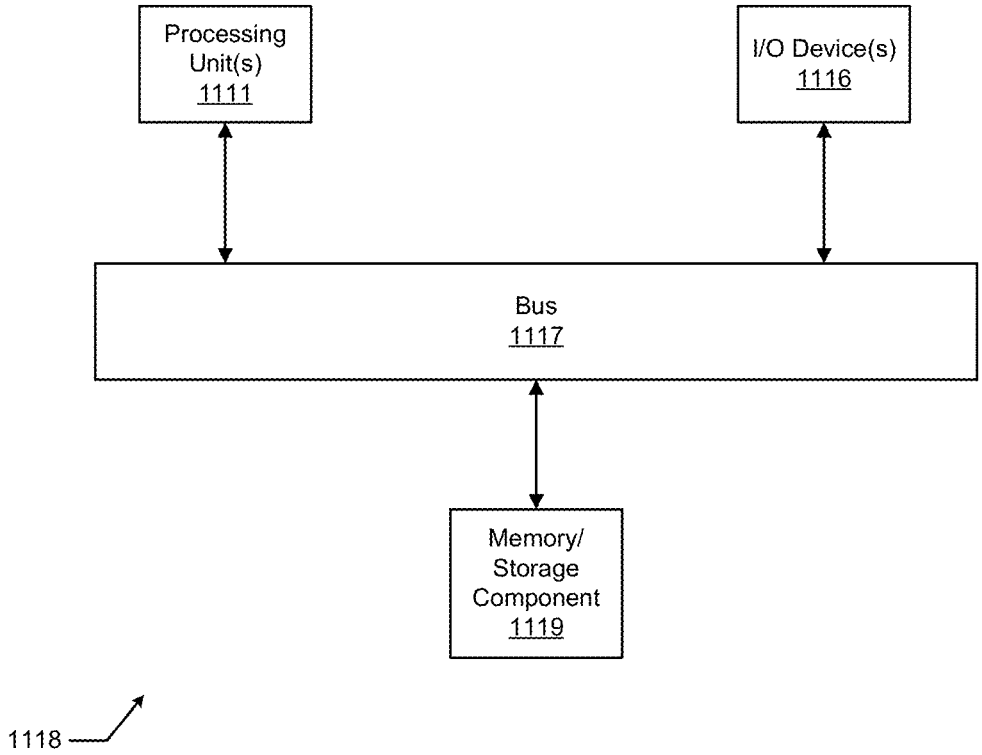
FIG. 11 shows a computing device in accordance with certain example embodiments.

FIG. 11 illustrates one embodiment of a computing device 1118 that implements one or more of the various techniques described herein, and which is representative, in whole or in part, of the elements described herein pursuant to certain exemplary embodiments. For example, computing device 1118 can be implemented in the controller 1004 of FIG. 10 in the form of a hardware processor, memory, and a storage repository, among other components. Computing device 1118 is one example of a computing device and is not intended to suggest any limitation as to scope of use or functionality of the computing device and/or its possible architectures. Neither should computing device 1118 be interpreted as having any dependency or requirement relating to any one or combination of components illustrated in the example computing device 1118.

Computing device 1118 includes one or more processors or processing units 1111, one or more memory/storage components 1115, one or more input/output (I/O) devices 1116, and a bus 1117 that allows the various components and devices to communicate with one another. Bus 1117 represents one or more of any of several types of bus structures, including a memory bus or memory controller, a peripheral bus, an accelerated graphics port, and a processor or local bus using any of a variety of bus architectures. Bus 1117 includes wired and/or wireless buses.

Memory/storage component 1115 represents one or more computer storage media. Memory/storage component 1115 includes volatile media (such as random access memory (RAM)) and/or nonvolatile media (such as read only memory (ROM), flash memory, optical disks, magnetic disks, and so forth). Memory/storage component 1115 includes fixed media (e.g., RAM, ROM, a fixed hard drive, etc.) as well as removable media (e.g., a Flash memory drive, a removable hard drive, an optical disk, and so forth).

One or more I/O devices 1116 allow a customer, utility, or other user to enter commands and information to computing device 1118, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 1118 is connected to a network (not shown) (e.g., a LAN, a WAN such as the Internet, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 1118 includes at least the minimal processing, input, and/or output means necessary to practice one or more embodiments.

Further, those skilled in the art will appreciate that one or more elements of the aforementioned computer device 1118 is located at a remote location and connected to the other elements over a network in certain exemplary embodiments. Further, one or more embodiments is implemented on a distributed system having one or more nodes, where each portion of the implementation (e.g., control engine) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

The systems, methods, and apparatuses described herein allow for freeing a service tool and/or other parts of a BHA from a subterranean wellbore without damaging the wellbore assembly and/or leaving part of the wellbore assembly behind for a separate fishing operation. Example embodiments can use one or multiple means of freeing a stuck service tool. Example embodiments are part of the wellbore assembly, but do not affect the operations being performed in the wellbore. Example embodiments can be controlled mechanically, hydraulically, electrically, and/or wirelessly.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An assembly disposed within a subterranean wellbore, the assembly comprising:

a reverse circulating tool coupled to a service tool disposed below the reverse circulating tool, wherein the service tool comprises a gravel pack or frac pack that slides within a packer, and wherein the reverse circulating tool is configured, when enabled at a first time, to direct fluid from an annulus through a reversing port into a tubing string thereby permitting a flow of the fluid to free the service tool from being stuck;

a jarring tool coupled to the reverse circulating tool and disposed above the reverse circulating tool, the jarring tool configured, when enabled at a second time, to cause a top portion of the jarring tool to slide against a bottom portion of the jarring tool thereby imparting a jarring force to the at least one service tool; and a disconnect tool comprising a top disconnect portion and a bottom disconnect portion, the top disconnect portion coupled to the tubing string and the bottom disconnect portion coupled to the jarring tool, the disconnect tool configured, when enabled at a third time, to cause the top disconnect portion to separate from the bottom disconnect portion.

2. The assembly of claim 1, wherein the reverse circulating tool comprises a piston mandrel and a ratcheting system that locks the piston mandrel in an upward position.

3. The assembly of claim 1, wherein the fluid is a pressurized fluid that enters into an aperture that results after a fracture disk ruptures, wherein the pressurized fluid opens at least one circulating port.

4. The assembly of claim 1, wherein the reverse circulating tool is enabled by increasing a pressure in the subterranean wellbore above a threshold value.

5. The assembly of claim 1, wherein the top portion is separated from the bottom portion when the tubing string is lifted toward a surface, and wherein the top portion falls against the bottom portion when the tubing string is subsequently released after being lifted toward the surface.

6. The assembly of claim 5, wherein the tubing string is lifted and subsequently released multiple times before determining whether the at least one service tool has been released.

7. The assembly of claim 1, wherein the service tool is utilized in a field operation, wherein the field operation causes the service tool to become stuck, wherein the field operation comprises at least one of a group consisting of a fracturing operation and a gravel packing operation.

8. The assembly of claim 1, wherein the second time is subsequent to the first time, and wherein the jarring tool is enabled when the reverse circulating tool, after being enabled, fails to free the service tool at the first time.

9. The assembly of claim 8, wherein the third time is subsequent to the second time, and wherein the disconnect tool is enabled when the reverse circulating tool and the jarring tool, after being enabled, fail to free the service tool at the first time or the second time.

10. The assembly of claim 9, wherein the disconnect tool comprises a shifting sleeve that engages a shear disc that severs the tubing string from the service tool.

11. A method of using the assembly of claim 1 for freeing a service tool from a subterranean wellbore, the method comprising:

determining, after a service operation has been performed by the service tool, that the service tool is stuck within the subterranean wellbore;

performing, using a first part of the assembly disposed in the subterranean wellbore between a tubing string and the service tool, a first action to free the service tool, disposed below the assembly in the subterranean wellbore, from being stuck; and retrieving, after performing the first action, the service tool by removing the tubing string from the subterranean formation.

12. The method of claim 11, wherein performing the first action comprises:

rupturing a fracture disk of the first part of the assembly to allow for a flow of fluid from an annulus of the assembly into a cavity of the assembly; and reversing at least one circulation pump to draw the fluid toward a surface through the cavity.

13. The method of claim 11, wherein performing the first action comprises:

lifting the tubing string upward out of the subterranean wellbore by a distance, wherein lifting the tubing string also lifts a top portion of the first part of the assembly; and releasing the tubing string, wherein the top portion falls the distance to collide with a bottom portion of the first part of the assembly.

14. The method of claim 13, wherein lifting the tubing string and subsequently releasing the tubing string is repeated multiple times.

15. The method of claim 11, further comprising:

performing, after performing the first action and using a second part of the assembly, a second action to free the service tool from being stuck, wherein the service tool is retrieved after performing the first action and the second action.

16. The method of claim 15, wherein the first action performed by the first part of the assembly is different from the second action performed by the second part of the assembly.

17. The method of claim 15, further comprising:

performing, after performing the first action and the second action and using a third part of the assembly, a third action;

withdrawing the tubing string from the subterranean wellbore;

inserting a fishing tool into the subterranean wellbore; and removing, using the fishing tool, the service tool from the subterranean wellbore.

* * * * *